US010137347B2

(12) United States Patent
Thornton et al.

(10) Patent No.: US 10,137,347 B2
(45) Date of Patent: Nov. 27, 2018

(54) GOLF CLUBS AND GOLF CLUB HEADS HAVING A SENSOR

(71) Applicant: NIKE, Inc, Beaverton, OR (US)

(72) Inventors: Douglas A. Thornton, Columbus, OH (US); Jeffrey A. Hadden, Columbus, OH (US); Bradley C. Glenn, Columbus, OH (US)

(73) Assignee: NIKE, Inc., Beaverton, OR (US)

( * ) Notice: Subject to any disclaimer, the term of this patent is extended or adjusted under 35 U.S.C. 154(b) by 105 days.

(21) Appl. No.: 15/144,520

(22) Filed: May 2, 2016

(65) Prior Publication Data

US 2017/0312571 A1 Nov. 2, 2017

(51) Int. Cl.

| | |
|---|---|
| ***A63B 24/00*** | (2006.01) |
| ***A63B 69/36*** | (2006.01) |
| ***A63B 53/04*** | (2015.01) |
| ***A63B 60/16*** | (2015.01) |

(52) U.S. Cl.

CPC ..... *A63B 69/36* (2013.01); *A63B 24/0003* (2013.01); *A63B 53/04* (2013.01); *A63B 53/0466* (2013.01); *A63B 60/16* (2015.10); *A63B 2024/0012* (2013.01); *A63B 2220/13* (2013.01); *A63B 2220/34* (2013.01); *A63B 2220/40* (2013.01); *A63B 2220/44* (2013.01); *A63B 2220/803* (2013.01); *A63B 2220/833* (2013.01); *A63B 2225/20* (2013.01); *A63B 2225/50* (2013.01)

(58) Field of Classification Search

None

See application file for complete search history.

(56) References Cited

U.S. PATENT DOCUMENTS

| | | | |
|---|---|---|---|
| 3,270,564 | A | 9/1966 | Evans |
| 3,788,647 | A | 1/1974 | Evans |
| 3,792,863 | A | 2/1974 | Evans |
| 3,806,131 | A | 4/1974 | Evans |
| 3,945,646 | A | 3/1976 | Hammond |
| 4,898,389 | A | 2/1990 | Plutt |
| 4,940,236 | A | 7/1990 | Allen |
| 4,991,850 | A | 2/1991 | Wilhlem |

(Continued)

FOREIGN PATENT DOCUMENTS

| | | | |
|---|---|---|---|
| CA | 2139690 | A1 | 7/1996 |
| CN | 2411030 | Y | 12/2000 |

(Continued)

OTHER PUBLICATIONS

Jul. 6, 2017—(WO) ISR & WO—App. No. PCT/US2017/030036.

*Primary Examiner* — Damon Pierce

(74) *Attorney, Agent, or Firm* — Banner & Witcoff, Ltd.

(57) ABSTRACT

A golf club having a sensor that is removably connected at one or more positions of the golf club where the sensor comprises an inertial measurement unit including an accelerometer capable of measuring linear accelerations in three orthogonal axes and a gyroscope capable of measuring an angular rate of rotation around the same axes. The sensor may further comprise a processor which may perform instructions to detect the impact of the golf club with a golf ball and determine the start of the golf swing without any additional input from the user. The sensor may further have a power management system to extend the life of the power source.

14 Claims, 11 Drawing Sheets

(56) References Cited

U.S. PATENT DOCUMENTS 5,221,088 A 6/1993 McTeigue et al.
5,233,544 A 8/1993 Kobayashi
5,245,537 A 9/1993 Barber
5,332,225 A 7/1994 Ura
5,354,063 A 10/1994 Curchod
5,364,093 A 11/1994 Huston et al.
5,372,365 A 12/1994 McTeigue et al.
5,413,345 A 5/1995 Nauck
5,429,327 A 7/1995 Adams
5,441,269 A 8/1995 Henwood
5,478,082 A 12/1995 De Knight et al.
5,507,485 A 4/1996 Fisher
5,524,081 A 6/1996 Paul
5,616,832 A 4/1997 Nauck
5,634,855 A 6/1997 King
5,681,993 A 10/1997 Heitman
5,718,641 A 2/1998 Lin
5,724,265 A 3/1998 Hutchings
5,728,006 A 3/1998 Teitell et al.
5,779,555 A 7/1998 Nomura et al.
5,792,000 A 8/1998 Weber et al.
5,792,001 A 8/1998 Henwood
5,826,874 A 10/1998 Teitell et al.
5,951,410 A 9/1999 Butler et al.
5,955,667 A 9/1999 Fyfe
5,973,596 A 10/1999 French et al.
6,012,988 A 1/2000 Burke
6,018,705 A 1/2000 Gaudet et al.
6,044,704 A 4/2000 Sacher
6,045,364 A 4/2000 Dugan et al.
6,052,654 A 4/2000 Gaudet et al.
6,196,932 B1 3/2001 Marsh et al.
6,224,493 B1 5/2001 Lee et al.
6,248,021 B1 6/2001 Ognjanovic
6,261,102 B1 7/2001 Dugan et al.
6,270,422 B1 8/2001 Fisher
6,299,553 B1 10/2001 Petuchowski et al.
6,402,634 B2 6/2002 Lee et al.
6,413,167 B1 7/2002 Burke
6,430,843 B1 8/2002 Potter et al.
6,431,990 B1 8/2002 Manwaring
6,441,745 B1 8/2002 Gates
6,456,938 B1 9/2002 Barnard
6,561,917 B2 5/2003 Manwaring
6,579,190 B2 6/2003 Yamamoto
6,607,450 B1 8/2003 Hackman
6,638,175 B2 10/2003 Lee et al.
6,648,769 B2 11/2003 Lee et al.
6,697,820 B1 2/2004 Tarlie
6,757,572 B1 6/2004 Forest
6,802,772 B1 10/2004 Kunzle et al.
6,819,247 B2 11/2004 Bimbach et al.
6,821,209 B2 11/2004 Manwaring et al.
6,876,947 B1 4/2005 Darley et al.
6,882,955 B1 4/2005 Ohlenbusch et al.
6,900,759 B1 5/2005 Katayama
6,923,729 B2 8/2005 McGinty et al.
6,929,558 B2 8/2005 Manwaring et al.
6,991,552 B2 1/2006 Burke
7,004,848 B2 2/2006 Konow
7,021,140 B2 4/2006 Perkins
7,037,198 B2 5/2006 Hameen-Anttila
7,041,014 B2 5/2006 Wright et al.
7,118,498 B2 10/2006 Meadows et al.
7,121,962 B2 10/2006 Reeves
7,125,340 B1 10/2006 Priester et al.
7,160,200 B2 1/2007 Grober
7,175,177 B2 2/2007 Meifu et al.
7,175,511 B2 2/2007 Ueda et al.
7,214,138 B1 5/2007 Stivers et al.
7,234,351 B2 6/2007 Perkins
7,235,020 B1 6/2007 Christensen
7,264,554 B2 9/2007 Bentley
7,264,555 B2 9/2007 Lee et al.
7,310,895 B2 12/2007 Whittlesey et al.
7,602,301 B1 10/2009 Stirling et al.
7,627,451 B2 12/2009 Vock et al.
7,647,071 B2 1/2010 Rofougaran et al.
7,691,004 B1 4/2010 Lueders
7,736,242 B2 6/2010 Stites et al.
7,768,415 B2 8/2010 Blackadar
7,771,263 B2 8/2010 Telford
7,780,535 B2 8/2010 Hagood et al.
7,789,742 B1 9/2010 Murdock et al.
7,800,480 B1 9/2010 Joseph et al.
7,801,575 B1 9/2010 Balardeta et al.
7,804,404 B1 9/2010 Balardeta et al.
7,811,182 B2 10/2010 Ligotti, III et al.
7,821,407 B2 10/2010 Shears et al.
7,825,815 B2 11/2010 Shears et al.
7,831,212 B1 11/2010 Balardeta et al.
7,837,574 B2 11/2010 Brunner
7,837,575 B2 11/2010 Lee et al.
7,853,211 B1 12/2010 Balardeta et al.
7,857,705 B1 12/2010 Galloway
7,881,499 B2 2/2011 Bissonnette et al.
7,883,428 B1 2/2011 Balardeta et al.
7,887,440 B2 2/2011 Wright et al.
7,892,102 B1 2/2011 Galloway
7,941,097 B1 5/2011 Balardeta et al.
7,946,926 B1 5/2011 Balardeta et al.
7,957,767 B2 6/2011 Rofougaran
7,978,081 B2 7/2011 Shears et al.
8,025,586 B2 9/2011 Teramoto
8,052,539 B2 11/2011 Kimber
8,117,903 B2 2/2012 Golden et al.
8,226,495 B2 7/2012 Savarese et al.
8,330,284 B2 12/2012 Weston et al.
8,337,335 B2 12/2012 Dugan
8,342,978 B2 1/2013 Tamura
8,430,770 B2 4/2013 Dugan
8,465,376 B2 6/2013 Bentley
8,593,286 B2 11/2013 Razoumov et al.
8,672,779 B1 3/2014 Sakyo et al.
8,696,450 B2 4/2014 Rose et al.
8,715,096 B2 5/2014 Cherbini
8,784,228 B2 7/2014 Morin et al.
8,801,532 B2 8/2014 Katayama
8,840,483 B1 9/2014 Steusloff et al.
8,894,502 B2 11/2014 Rose
8,941,723 B2 1/2015 Bentley et al.
8,994,826 B2 3/2015 Bentley
9,211,439 B1 12/2015 Pedenko et al.
9,557,386 B2 1/2017 Henderson et al.
9,804,792 B2 10/2017 Haensly et al.
2001/0005695 A1 6/2001 Lee et al.
2001/0035880 A1 11/2001 Musatov et al.
2001/0053720 A1 12/2001 Lee et al.
2002/0004723 A1 1/2002 Meifu et al.
2002/0019677 A1 2/2002 Lee
2002/0049507 A1 4/2002 Hameen-Anttila
2002/0052246 A1 5/2002 Burke
2002/0052750 A1 5/2002 Hirooka
2002/0072815 A1 6/2002 McDonough et al.
2002/0077189 A1 6/2002 Tuer et al.
2002/0082775 A1 6/2002 Meadows et al.
2002/0107085 A1 8/2002 Lee et al.
2002/0123386 A1 9/2002 Perlmutter
2002/0151994 A1 10/2002 Sisco
2002/0160848 A1 10/2002 Burke
2002/0173364 A1 11/2002 Boscha
2002/0173365 A1 11/2002 Boscha
2002/0183657 A1 12/2002 Socci et al.
2003/0008722 A1 1/2003 Konow
2003/0009913 A1 1/2003 Potter et al.
2003/0014134 A1 1/2003 Morgan
2003/0036436 A1 2/2003 Casanova et al.
2003/0040380 A1 2/2003 Wright et al.
2003/0132844 A1 7/2003 Walker
2003/0191547 A1 10/2003 Morse
2003/0207718 A1 11/2003 Perlmutter
2004/0067797 A1 4/2004 Knecht
2004/0106460 A1 6/2004 Lee et al.
2004/0142603 A1 7/2004 Walker

(56) References Cited

U.S. PATENT DOCUMENTS

2004/0177531 A1 9/2004 DiBenedetto et al.
2004/0204257 A1 10/2004 Boscha et al.
2004/0225199 A1 11/2004 Evanyk et al.
2004/0259651 A1 12/2004 Storek
2005/0017454 A1 1/2005 Endo et al.
2005/0032582 A1 2/2005 Mahajan et al.
2005/0037862 A1 2/2005 Hagood et al.
2005/0043109 A1 2/2005 Buckley et al.
2005/0054457 A1 3/2005 Eyestone et al.
2005/0079922 A1 4/2005 Priester et al.
2005/0096761 A1 5/2005 Hanover et al.
2005/0188566 A1 9/2005 Whittlesey et al.
2005/0215340 A1 9/2005 Stites et al.
2005/0227775 A1 10/2005 Cassady et al.
2005/0240294 A1 10/2005 Jones et al.
2005/0261073 A1 11/2005 Farrington et al.
2005/0282650 A1 12/2005 Miettinen et al.
2005/0288119 A1 12/2005 Wang et al.
2006/0025229 A1 2/2006 Mahajan et al.
2006/0029916 A1 2/2006 Boscha
2006/0040757 A1 2/2006 Rosselli
2006/0052173 A1 3/2006 Telford
2006/0063600 A1 3/2006 Grober
2006/0084516 A1 4/2006 Eyestone et al.
2006/0089845 A1 4/2006 Marcell et al.
2006/0094520 A1 5/2006 Kostuj
2006/0105849 A1 5/2006 Brunner
2006/0105853 A1 5/2006 Glass
2006/0109116 A1 5/2006 Keays
2006/0122002 A1 6/2006 Konow
2006/0166737 A1 7/2006 Bentley
2006/0166738 A1 7/2006 Eyestone et al.
2006/0184336 A1 8/2006 Kolen
2006/0194178 A1 8/2006 Goldstein
2006/0199659 A1 9/2006 Caldwell
2006/0224306 A1 10/2006 Workman et al.
2006/0276256 A1 12/2006 Storek
2006/0287118 A1 12/2006 Wright et al.
2007/0006489 A1 1/2007 Case et al.
2007/0010341 A1 1/2007 Miettinen et al.
2007/0011919 A1 1/2007 Case
2007/0087866 A1 4/2007 Meadows et al.
2007/0111811 A1 5/2007 Grober
2007/0129178 A1 6/2007 Reeves
2007/0135225 A1 6/2007 Nieminen et al.
2007/0135237 A1 6/2007 Reeves
2007/0191126 A1 8/2007 Mandracken
2007/0238538 A1 10/2007 Priester
2007/0270214 A1 11/2007 Bentley
2008/0039222 A1 2/2008 Kiraly
2008/0051208 A1 2/2008 Lee et al.
2008/0076580 A1 3/2008 Murdock et al.
2008/0085778 A1 4/2008 Dugan
2008/0085788 A1 4/2008 Rainer et al.
2008/0125288 A1 5/2008 Case
2008/0188310 A1 8/2008 Murdock
2008/0200275 A1 8/2008 Wagen et al.
2008/0218343 A1 9/2008 Lee et al.
2008/0242354 A1 10/2008 Rofougaran
2008/0287205 A1 11/2008 Katayama
2008/0318703 A1 12/2008 Mooney
2009/0018795 A1 1/2009 Priester et al.
2009/0048070 A1 2/2009 Vincent et al.
2009/0111602 A1 4/2009 Savarese et al.
2009/0120197 A1 5/2009 Golden et al.
2009/0131190 A1 5/2009 Kimber
2009/0131191 A1 5/2009 Priester et al.
2009/0163285 A1 6/2009 Kwon et al.
2009/0165530 A1 7/2009 Golden et al.
2009/0165531 A1 7/2009 Golden et al.
2009/0203460 A1 8/2009 Clark
2009/0209358 A1 8/2009 Niegowski
2009/0247312 A1 10/2009 Sato et al.
2009/0254204 A1 10/2009 Kostuj
2009/0260426 A1 10/2009 Lieberman et al.
2009/0270743 A1 10/2009 Dugan et al.
2010/0048314 A1 2/2010 Hsu et al.
2010/0049468 A1 2/2010 Papadourakis
2010/0063778 A1 3/2010 Schrock et al.
2010/0063779 A1 3/2010 Schrock et al.
2010/0067566 A1 3/2010 Rofougaran et al.
2010/0093457 A1 4/2010 Ahem et al.
2010/0093458 A1 4/2010 Davenport et al.
2010/0099509 A1 4/2010 Ahem et al.
2010/0113174 A1 5/2010 Ahem
2010/0117837 A1 5/2010 Stirling et al.
2010/0121227 A1 5/2010 Stirling et al.
2010/0121228 A1 5/2010 Stirling et al.
2010/0130298 A1 5/2010 Dugan et al.
2010/0144455 A1 6/2010 Ahem
2010/0144456 A1 6/2010 Ahem
2010/0154255 A1 6/2010 Robinson et al.
2010/0201512 A1 8/2010 Stirling et al.
2010/0210371 A1 8/2010 Sato et al.
2010/0216563 A1 8/2010 Stites et al.
2010/0216564 A1 8/2010 Stites et al.
2010/0216565 A1 8/2010 Stites et al.
2010/0222152 A1 9/2010 Jaekel et al.
2010/0255922 A1 10/2010 Lueders
2010/0304877 A1 12/2010 Iwahashi et al.
2010/0308105 A1 12/2010 Savarese et al.
2011/0028230 A1 2/2011 Balardeta et al.
2011/0053698 A1 3/2011 Stites et al.
2011/0081978 A1 4/2011 Murdock et al.
2011/0082571 A1 4/2011 Murdock et al.
2011/0087344 A1 4/2011 Murdock et al.
2011/0092260 A1 4/2011 Murdock et al.
2011/0130223 A1 6/2011 Murdock et al.
2011/0151977 A1 6/2011 Murdock et al.
2011/0212757 A1 9/2011 Murdock et al.
2011/0224011 A1 9/2011 Denton et al.
2011/0224025 A1 9/2011 Balardeta et al.
2011/0230273 A1 9/2011 Niegowski et al.
2011/0281621 A1 11/2011 Murdock et al.
2011/0306435 A1 12/2011 Seo
2012/0019140 A1 1/2012 Maxik et al.
2012/0052972 A1 3/2012 Bentley
2012/0088544 A1 4/2012 Bentley et al.
2012/0120572 A1 5/2012 Bentley
2012/0191405 A1 7/2012 Molyneux et al.
2012/0289354 A1 11/2012 Cottam et al.
2012/0316004 A1 12/2012 Shibuya
2013/0041590 A1 2/2013 Burich et al.
2013/0065711 A1 3/2013 Ueda et al.
2013/0260922 A1 10/2013 Yontz et al.
2013/0324274 A1 12/2013 Stites
2014/0018181 A1 1/2014 Blake et al.
2014/0135139 A1 5/2014 Shibuya et al.
2014/0228649 A1 8/2014 Rayner et al.
2014/0323235 A1 10/2014 Stites et al.
2014/0364246 A1 12/2014 Davenport
2015/0142374 A1 5/2015 Shibuya
2015/0224371 A1 8/2015 Kato
2015/0238813 A1* 8/2015 Saiki ..... G06K 9/00342 702/141
2016/0089568 A1 3/2016 Shibuya
2016/0114212 A1 4/2016 Case, Jr.
2016/0175648 A1 6/2016 Kodaira
2016/0175649 A1 6/2016 Ukawa
2016/0175650 A1 6/2016 Sato et al.
2016/0175680 A1 6/2016 Sato

FOREIGN PATENT DOCUMENTS

CN 2487416 Y 4/2002
CN 2688331 Y 3/2005
CN 1984698 A 6/2007
CN 101352609 A 1/2009
CN 101918090 A 12/2010
CN 101927084 A 12/2010
DE 202007013632 U1 12/2007
EP 2332619 A1 6/2011
JP S62176470 A 8/1987
JP H03-60680 A 3/1991

(56) References Cited

FOREIGN PATENT DOCUMENTS

| | | | |
|---|---|---|---|
| JP | H0355077 | A | 3/1991 |
| JP | H06237 | | 1/1994 |
| JP | H08000785 | | 1/1996 |
| JP | H08131599 | A | 5/1996 |
| JP | H08173586 | | 7/1996 |
| JP | 2001264016 | A | 9/2001 |
| JP | 2006247023 | A | 9/2006 |
| JP | 2008506421 | A | 3/2008 |
| JP | 2008073210 | A | 4/2008 |
| JP | 2008289866 | A | 12/2008 |
| JP | 2009534546 | A | 9/2009 |
| JP | 06000237 | B2 | 9/2016 |
| KR | 20060090501 | A | 8/2006 |
| KR | 1020060114969 | | 11/2006 |
| KR | 20070095407 | A | 9/2007 |
| KR | 20090129246 | A | 12/2009 |
| KR | 20100020131 | A | 2/2010 |
| KR | 20100051153 | A | 5/2010 |
| KR | 20100095917 | A | 9/2010 |
| KR | 101002846 | B1 | 12/2010 |
| KR | 20110005247 | A | 1/2011 |
| WO | 1999065574 | A2 | 12/1999 |
| WO | 0215993 | A1 | 2/2002 |
| WO | 2004056425 | A2 | 7/2004 |
| WO | 2005094953 | A2 | 10/2005 |
| WO | 2005118086 | A1 | 12/2005 |
| WO | 2006014459 | A2 | 2/2006 |
| WO | 2012027726 | A2 | 3/2012 |
| WO | 2012138543 | A2 | 10/2012 |
| WO | 2012149385 | A1 | 11/2012 |
| WO | 2016054249 | A1 | 4/2016 |

* cited by examiner

GOLF CLUBS AND GOLF CLUB HEADS HAVING A SENSOR

TECHNICAL FIELD

Aspects of this disclosure generally relate to golf clubs and golf club heads. More particularly, aspects of this disclosure relate to golf clubs and golf club heads having a sensor for detecting one or more swing parameters.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well-known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball and club models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. Further, other technological advancements have been made in an effort to better match the various elements and/or characteristics of the golf club and characteristics of a golf ball to a particular user's swing features or characteristics In addition to the golf equipment, the mechanics of the golf swing itself are also of interest to the player eager to improve his/her performance. Qualitative evaluation of a user's swing by a trained golfing professional has traditionally been helpful in correcting certain errors and honing skills of players of all experience levels.

As technology has evolved, the capability to mount sensors onto a golf club or other swinging device has become available. While sensors mounted to a golf club are helpful additional functionality is desired.

BRIEF SUMMARY

In light of the foregoing background, the following presents a simplified summary of the present disclosure in order to provide a basic understanding of some aspects of the various implementations of this disclosure. This summary is not an extensive overview of the embodiments described herein. It is not intended to identify key or critical elements, or to delineate the scope of the embodiments described in this disclosure. The following summary merely presents some concepts of the embodiments of this disclosure in a simplified form as a prelude to the more detailed description provided below.

Power Management

Yet another aspect to this disclosure relates a golf club comprising: a shaft and a golf club head, the shaft having a first end connected to the golf club head and a second end connected to a grip; a sensor connected to the golf club, the sensor comprising: a processor and an inertial measurement unit, the inertial measurement unit comprising an accelerometer capable of measuring linear accelerations in a first axis, a second axis, and a third axis and a gyroscope capable of measuring an angular rate of rotation about the first axis, the second axis, and the third axis, wherein the first axis, the second axis, and the third axis are orthogonally oriented and comprise a sensor coordinate system. A non-transitory computer readable medium storing computer readable instructions that, when executed by the processor, causes the processor to at least: acquire a first set of linear acceleration data from at least one axis of the accelerometer of the inertial measurement unit, where the accelerometer may be operating with a first sampling rate of 10 Hz or less. The processor may then compare the first set of linear acceleration data to a first set of predetermined criteria, wherein the first set of predetermined criteria comprises information indicative of non-zero linear acceleration data in at least one axis and wherein the first set of predetermined criteria is satisfied if information indicative of non-zero linear acceleration data in at least one axis. Upon determining that first set of criteria is satisfied, the processor may acquire a second set of linear acceleration data from the accelerometer, where the accelerometer may be operating at a second sampling rate greater than the first sampling rate. Next, the processor may calculate an orientation of the golf club from the second set of linear acceleration data and compare the calculated orientation of the golf club to a second set of predetermined criteria, where the second set of predetermined criteria comprises a rational golf club address position, and is satisfied when the calculated orientation of the golf club is equal to the rational golf club address position. Upon determining that the second set of predetermined criteria is satisfied, the processor may further collect a third set of linear acceleration data from the accelerometer and a first set of angular rate data from the gyroscope, where the accelerometer is operating at a third sampling rate greater than the second sampling rate and calculate whether or not an impact event has occurred based on the third set of linear acceleration data and the first set of angular rate data. Additionally, the second sampling rate may be within a range of 10 Hz and 50 Hz or may be approximately 20 Hz. The sensor may further comprise an antenna, a power source, and a magnetometer. The sensor may be removably connected to a golf club and operate a plurality of power consumption modes.

Further aspects of this disclosure may relate to the non-transitory computer readable medium stores computer readable instructions that determine if the impact event has occurred, when executed by the processor, further causes the processor to at least: compare the third set of linear acceleration data and the first set of angular rate data to a third set of predetermined criteria to determine if an impact event has occurred, where the third set of predetermined criteria may comprise transforming the angular rate of rotation data into transformed angular rate of rotation data into a golf club coordinate system; where the golf club coordinate system comprises a fourth axis is oriented in a heel-to-toe direction, a fifth axis is oriented in a front-to-back direction, and a sixth axis is oriented in a bottom-to-top direction. The processor may then calculate a slope of the transformed angular rate of rotation about the fourth, fifth, and sixth axes, and compare the slope of the transformed angular rate of rotation about the fourth, fifth, and sixth axes to a minimum value of a slope of the angular rate of rotation about the fourth axis and the sixth axis, and a maximum value of the slope of the angular rate of rotation about the fifth axis, and where the third set of predetermined criteria may be satisfied if the slopes of the transformed angular rates of rotation about the fourth axis and the sixth axis are greater than the minimum value of a slope of the angular rate of rotation about the fourth axis and the sixth axis, and the slope of the transformed angular rate of rotation about the fifth axis is less than a maximum value of the slope of the angular rate of rotation about the fifth axis. Upon determining if an impact event has occurred, the processor may calculate a set of golf related metrics from the third set of linear acceleration data and the first set of angular rate of rotation data and transmit the set of golf related metrics to a remote computing device.

Yet another aspect of this disclosure relates to the non-transitory computer readable medium storing computer readable instructions that, when executed by the processor, further causes the processor to at least: compare the third set of linear acceleration data and the first set of angular rate data to a fourth set of predetermined criteria, wherein the fourth set of predetermined criteria comprises information indicative of the sensor detecting no movement for a specified time period, and where the fourth set of predetermined criteria is satisfied if the sensor detects no movement for the a time period greater than the specified time period. Upon determining if the fourth set of predetermined criteria is met, the processor transitions the sensor to a low power state. The specified time period may be 10 seconds.

Still another aspect of this disclosure relates to a golf club comprising: a shaft and a golf club head, the shaft having a first end connected to the golf club head and a second end connected to a grip; a sensor removably connected to the golf club, operates a plurality of power consumption modes and comprises: an inertial measurement unit, a processor, a power source, and an antenna. The inertial measurement unit may comprises an accelerometer capable of measuring linear accelerations in a first axis, a second axis, and a third axis and a gyroscope capable of measuring angular rates of rotation about the first axis, the second axis, and the third axis, wherein the first axis, the second axis, and the third axis are orthogonally oriented and comprise a sensor coordinate system. A non-transitory computer readable medium storing computer readable instructions that, when executed by the processor, causes the processor to at least: acquire a first set of linear acceleration data from at a first sampling rate while providing power to the accelerometer located within the sensor, while restricting power to the gyroscope; compare the first set of linear acceleration data to a first set of predetermined criteria; where the first set of linear acceleration data comprises information indicative of non-zero linear acceleration data in at least one axis and wherein the first set of predetermined criteria is satisfied if information indicative of non-zero linear acceleration data in at least one axis. Upon determining that first set of predetermined criteria is satisfied, the processor may acquire a second set of linear acceleration data at a second sampling rate from the accelerometer, while providing power and restricting power to the gyroscope; wherein the second sampling rate is greater than the first sampling rate and calculate an orientation of the golf club from the second set of linear acceleration data. The processor then compares the orientation of the golf club to a second set of predetermined criteria; where the second set of predetermined criteria may comprise the golf club is in a rational golf club address position and that the second set of predetermined criteria is satisfied if the calculated orientation of the golf club is equal to the rational golf club address position. Upon determining that the second set of predetermined criteria is satisfied; the processor may collect a third set of linear acceleration data from the accelerometer and a first set of angular rate data from the gyroscope located within the sensor; where the accelerometer may be operating at a third sampling rate greater than the second sampling rate when the third set of linear acceleration data is collected. The processor next may compare the third set of linear acceleration data and the first set of angular rate data to a third set of predetermined criteria to determine if an impact event has occurred, and where the third set of predetermined criteria may comprise transforming the angular rate of rotation data into transformed angular rate of rotation data into a golf club coordinate system where the golf club coordinate system may comprise a fourth axis is oriented in a heel-to-toe direction, a fifth axis is oriented in a front-to-back direction, and a sixth axis is oriented in a bottom-to-top direction. The processor may then calculate a slope of the transformed angular rate of rotation about the fourth, fifth, and sixth axes and compare the slope of the transformed angular rate of rotation about the fourth, fifth, and sixth axes to a minimum value of a slope of the angular rate of rotation about the fourth axis and the sixth axis, and a maximum value of the slope of the angular rate of rotation about the fifth axis, and where the third set of predetermined criteria may be satisfied if the slopes of the transformed angular rates of rotation about the fourth axis and the sixth axis are greater than the minimum value of a slope of the angular rate of rotation about the fourth axis and the sixth axis, and the slope of the transformed angular rate of rotation about the fifth axis is less than a maximum value of the slope of the angular rate of rotation about the fifth axis. Upon determining if an impact event has occurred, the processor may calculate a plurality of golf related metrics from the third set of linear acceleration data and the first set of angular rate of rotation data and provide power to the antenna and transmit the plurality of golf related metrics to a remote computing device, while restricting power to the accelerometer and the gyroscope. The plurality of golf related metrics may be transmitted to the remote computing device at a rate within a range of 0.75 MB/s and 2.0 MB/s.

And another aspect of this disclosure may relate to a system of measuring a golf swing comprising: a golf club comprising: a shaft and a golf club head, the shaft having a first end connected to the golf club head and a second end connected to a grip; a sensor removably connected to the golf club, the sensor operates a plurality of power consumption modes, the sensor comprising: an inertial measurement unit, a processor, a power source, and an antenna. A non-transitory computer readable medium storing computer readable instructions that, when executed by the processor, causes the processor to at least: acquire a first set of linear acceleration data from at a first sampling rate while providing power to the accelerometer located within the sensor, while restricting power to the gyroscope; compare the first set of linear acceleration data to a first set of predetermined criteria; where the first set of linear acceleration data comprises information indicative of non-zero linear acceleration data in at least one axis and wherein the first set of predetermined criteria is satisfied if information indicative of non-zero linear acceleration data in at least one axis. Upon determining that first set of predetermined criteria is satisfied, the processor may acquire a second set of linear acceleration data at a second sampling rate from the accelerometer, while providing power and restricting power to the gyroscope; wherein the second sampling rate is greater than the first sampling rate and calculate an orientation of the golf club from the second set of linear acceleration data. The processor then compares the orientation of the golf club to a second set of predetermined criteria; where the second set of predetermined criteria may comprise the golf club is in a rational golf club address position and that the second set of predetermined criteria is satisfied if the calculated orientation of the golf club is equal to the rational golf club address position. Upon determining that the second set of predetermined criteria is satisfied; the processor may collect a third set of linear acceleration data from the accelerometer and a first set of angular rate data from the gyroscope located within the sensor; where the accelerometer may be operating at a third sampling rate greater than the second sampling rate when the third set of linear acceleration data is collected. The processor next may compare the third set of linear acceleration data and the first set of angular rate data to a third set of predetermined criteria to determine if an impact event has occurred, and where the third set of predetermined criteria may comprise transforming the angular rate of rotation data into transformed angular rate of rotation data into a golf club coordinate system where the golf club coordinate system may comprise a fourth axis is oriented in a heel-to-toe direction, a fifth axis is oriented in a front-to-back direction, and a sixth axis is oriented in a bottom-to-top direction. The processor may then calculate a slope of the transformed angular rate of rotation about the fourth, fifth, and sixth axes and compare the slope of the transformed angular rate of rotation about the fourth, fifth, and sixth axes to a minimum value of a slope of the angular rate of rotation about the fourth axis and the sixth axis, and a maximum value of the slope of the angular rate of rotation about the fifth axis, and where the third set of predetermined criteria may be satisfied if the slopes of the transformed angular rates of rotation about the fourth axis and the sixth axis are greater than the minimum value of a slope of the angular rate of rotation about the fourth axis and the sixth axis, and the slope of the transformed angular rate of rotation about the fifth axis is less than a maximum value of the slope of the angular rate of rotation about the fifth axis. Upon determining if an impact event has occurred, the processor may transmit the third set of linear acceleration data and the first set of angular rate of rotation data to a remote computing device.

Impact Detection

In one aspect, this disclosure may relate to a golf club comprising: a shaft and a golf club head, the shaft having a first end connected to the golf club head and a second end connected to a grip; a sensor connected to the golf club, the sensor comprising: a processor and an inertial measurement unit, the inertial measurement unit comprising an accelerometer capable of measuring linear accelerations along a first axis, along a second axis, and along a third axis and a gyroscope capable of measuring an angular rate of rotation about the first axis, about the second axis, and about the third axis, wherein the first axis, the second axis, and the third axis comprise an orthogonally oriented sensor coordinate system. A non-transitory computer readable medium storing computer readable instructions that, when executed by the processor, causes the processor to at least: acquire linear acceleration data from the accelerometer of the inertial measurement unit, where the linear acceleration data may be taken at a constant sampling rate; acquire angular rate of rotation data from the gyroscope of the inertial measurement unit, where the angular rate of rotation data may be taken at a constant sampling rate; and transform the linear acceleration data into transformed linear acceleration data with respect to a golf club coordinate system that comprises a fourth axis may be oriented in a heel-to-toe direction, a fifth axis may be oriented in a front-to-back direction, and a sixth axis may be oriented in a bottom-to-top direction. The processor may also transform the angular rate of rotation data into transformed angular rate of rotation data with respect to the golf club coordinate system; calculate an orientation of the golf club from the transformed linear acceleration data; compare the calculated orientation of the golf club to a first set of predetermined criteria, where the first set of predetermined criteria may correspond to the golf club being oriented in a rational golf club address position and where the first set of predetermined criteria may be satisfied when the calculated orientation of the golf club matches the rational golf club address position. Upon determining that the first set of predetermined criteria is satisfied, the processor may compare the transformed angular rate of rotation data to a second set of predetermined criteria, where the second set of predetermined criteria may comprise a range of transformed angular rate of rotation values and where the second set of predetermined criteria may be satisfied when the transformed angular rate of rotation data falls within the range of transformed angular rate of rotation values. Upon determining that the second set of predetermined criteria is satisfied, the processor may output an indication that the golf club is in a rational golf club address position and an indication that the transformed angular rate of rotation data represent a golf swing.

Additional aspects of this disclosure may relate to the non-transitory computer readable medium storing computer readable instructions when executed by the processor, further cause the processor to at least: upon determining that the second set of predetermined criteria is satisfied, calculate a slope of the transformed angular rate of rotation data about the fourth axis, the fifth axis, and the sixth axis; and compare the slope of the angular rate of rotation data around the fourth axis and the sixth axis to a third set of predetermined criteria. The third set of predetermined criteria may comprise a fourth axis specified slope of angular rate of rotation and a sixth axis specified slope of angular rate of rotation and may be satisfied when the slope of the transformed angular rate of rotation data around the fourth axis is greater than the fourth axis specified slope of angular rate of rotation and the slope of the transformed angular rate of rotation data around the sixth axis is greater than the sixth axis specified slope of angular rate of rotation. Upon determining that the third set of predetermined criteria is satisfied, the processor may then compare the slope of the angular rate of rotation data around the fifth axis to a fourth set of predetermined criteria, where the fourth set of predetermined criteria may comprise a fifth axis specified slope of angular rate of rotation. The fourth set of predetermined criteria may be satisfied if the slope of the transformed angular rate of rotation data around the fifth axis is less than the fifth axis specified slope of angular rate of rotation. Upon determining that the fourth set of predetermined criteria is satisfied, the processor may next compare the transformed linear acceleration data along the fifth axis to a fifth set of predetermined criteria, where the fifth set of predetermined criteria may comprise a specified linear acceleration value along the fifth axis, and where the fifth set of predetermined criteria may be satisfied if the linear acceleration data is greater than the specified linear acceleration value along the fifth axis. Upon determining that the fifth set of predetermined criteria is satisfied, the processor may compare the transformed angular rate of rotation data around the fourth axis to a sixth set of predetermined criteria, where the sixth set of predetermined criteria may comprise a specified value for angular rate of rotation about the fourth axis and where the sixth set of predetermined criteria is satisfied if the angular rate of rotation data around the fourth axis is greater than the specified value for the angular rate of rotation about the fourth axis. Lastly, upon determining that the sixth set of predetermined criteria is satisfied, the processor may transmit a signal that an impact between a golf ball and the golf club has occurred.

Other aspects of this disclosure may relate to a rational golf club address position comprising the golf club being positioned with a sole of the golf club facing downward and an angle from a vertical plane to a hosel axis of the golf club within a range of 10 degrees to 45 degrees. The range of transformed angular rate of rotation values is within 250 degrees per second and 2,800 degrees per second. The golf club may be a putter, an iron-type golf club, or a wood-type golf club. Also, the sensor may be connected to the golf club head or positioned near the grip of the golf club.

Another aspect of this disclosure may relate to a golf club comprising: a shaft and a golf club head, the shaft having a first end connected to the golf club head and a second end connected to a grip; a sensor connected to the golf club, the sensor comprising: a processor and an inertial measurement unit, the inertial measurement unit comprising an accelerometer capable of measuring linear accelerations along a first axis, along a second axis, and along a third axis and a gyroscope capable of measuring an angular rate of rotation about the first axis, about the second axis, and about the third axis, wherein the first axis, the second axis, and the third axis comprise an orthogonally oriented sensor coordinate system. A non-transitory computer readable medium storing computer readable instructions that, when executed by the processor, causes the processor to at least: acquire linear acceleration data from the accelerometer of the inertial measurement unit, where the linear acceleration data may be taken at a constant sampling rate; acquire angular rate of rotation data from the gyroscope of the inertial measurement unit, where the angular rate of rotation data may be taken at a constant sampling rate; and transform the linear acceleration data into transformed linear acceleration data with respect to a golf club coordinate system that comprises a fourth axis may be oriented in a heel-to-toe direction, a fifth axis may be oriented in a front-to-back direction, and a sixth axis may be oriented in a bottom-to-top direction. The processor may also transform the angular rate of rotation data into transformed angular rate of rotation data with respect to the golf club coordinate system; calculate an orientation of the golf club from the transformed linear acceleration data; compare the calculated orientation of the golf club to a first set of predetermined criteria, where the first set of predetermined criteria may correspond to the golf club being oriented in a rational golf club address position and where the first set of predetermined criteria may be satisfied when the calculated orientation of the golf club matches the rational golf club address position. Upon determining that the first set of predetermined criteria is satisfied, the processor may compare the transformed angular rate of rotation data to a second set of predetermined criteria, where the second set of predetermined criteria may comprise a range of transformed angular rate of rotation values and where the second set of predetermined criteria may be satisfied when the transformed angular rate of rotation data falls within the range of transformed angular rate of rotation values. Upon determining that the second set of predetermined criteria is satisfied, the processor may calculate a slope of the transformed angular rate of rotation data about the fourth axis, the fifth axis, and the sixth axis; and compare the slope of the angular rate of rotation data around the fourth axis and the sixth axis to a third set of predetermined criteria. The third set of predetermined criteria may comprise a fourth axis specified slope of angular rate of rotation and a sixth axis specified slope of angular rate of rotation and may be satisfied when the slope of the transformed angular rate of rotation data around the fourth axis is greater than the fourth axis specified slope of angular rate of rotation and the slope of the transformed angular rate of rotation data around the sixth axis is greater than the sixth axis specified slope of angular rate of rotation. Upon determining that the third set of predetermined criteria is satisfied, the processor may then compare the slope of the angular rate of rotation data around the fifth axis to a fourth set of predetermined criteria, where the fourth set of predetermined criteria may comprise a fifth axis specified slope of angular rate of rotation. The fourth set of predetermined criteria may be satisfied if the slope of the transformed angular rate of rotation data around the fifth axis is less than the fifth axis specified slope of angular rate of rotation. Upon determining that the fourth set of predetermined criteria is satisfied, the processor may next compare the transformed linear acceleration data along the fifth axis to a fifth set of predetermined criteria, where the fifth set of predetermined criteria may comprise a specified linear acceleration value along the fifth axis, and where the fifth set of predetermined criteria may be satisfied if the linear acceleration data is less than the specified linear acceleration value along the fifth axis. Upon determining that the fifth set of predetermined criteria is satisfied, the processor may compare the transformed angular rate of rotation data around the fourth axis to a sixth set of predetermined criteria, where the sixth set of predetermined criteria may comprise a specified value for angular rate of rotation about the fourth axis and where the sixth set of predetermined criteria is satisfied if the angular rate of rotation data around the fourth axis is greater than the specified value for the angular rate of rotation about the fourth axis. Lastly, upon determining that the sixth set of predetermined criteria is satisfied, the processor may transmit a signal that an impact between a golf ball and the golf club has occurred.

Other aspects of this disclosure may relate to the fourth axis specified slope of angular rate of rotation is 226 degrees per second squared and the sixth axis specified slope of angular rate of rotation is 226 degrees per second squared. The fifth axis specified slope of angular rate of rotation is 226 degrees per second squared. The specified linear acceleration value along the fifth axis is less than 0.24 g's. The specified value for the angular rate of rotation about the fourth axis is greater than −18.6 degrees per second.

Yet another aspect of this disclosure may relate to a golf club comprising: a shaft and a golf club head, the shaft having a first end connected to a golf club head and a second end connected to a grip; a sensor connected to the golf club comprising an inertial measurement unit, a processor, and a power source, where the inertial measurement unit comprises an accelerometer capable of measuring linear accelerations in a first axis, a second axis, and a third axis and a gyroscope capable of measuring an angular rate of rotation about the first axis, the second axis, and the third axis, wherein the first axis, the second axis, and the third axis comprise an orthogonally oriented sensor coordinate system. A non-transitory computer readable medium storing computer readable instructions that, when executed by the processor, cause the processor to at least: acquire linear acceleration data from the accelerometer; acquire angular rate of rotation data from the gyroscope; where the linear acceleration data and the angular rate of rotation data are taken at a constant sampling rate. The processor then may transform the linear acceleration data into transformed linear acceleration data with respect to a golf club coordinate system where a fourth axis may be oriented in a heel-to-toe direction, a fifth axis may be oriented in a front-to-back direction, and a sixth axis may be oriented in a bottom-to-top direction, and may also transform the angular rate of rotation data into transformed angular rate of rotation data with respect to the golf club coordinate system. Next, the processor may calculate a slope of the transformed angular rate of rotation data about the fourth axis, the fifth axis, and the sixth axis and may compare the transformed linear acceleration data along the fourth, fifth, and sixth axes, the transformed angular rate of rotation data about the fourth, fifth, and sixth axes and the slope of the transformed angular rate of rotation data about the fourth, fifth, and sixth axes to a plurality of predetermined criteria. Upon determining the plurality of predetermined criteria is satisfied, the processor may output that an impact between a golf ball and the golf club has occurred. The plurality of predetermined criteria may comprise a minimum value of the slope of the angular rate of rotation about the fourth and the sixth axis, and a maximum value of the slope of the angular rate of rotation about the fifth axis. The golf club may be a putter and the sensor is positioned near the grip of the golf club, where the minimum value of the slope of the angular rate of rotation around the fourth and the sixth axis is 226 degrees per second squared and the maximum value of the slope of the angular rate of rotation around the fifth axis is 226 degrees per second squared.

Swing Start Detection

Still other aspects of this disclosure may relate a golf club comprising: a shaft and a golf club head, the golf shaft having a first end connected to the golf club head and a second end connected to a grip; a sensor connected to the golf club, the sensor comprising: an inertial measurement unit, the inertial measurement unit comprising an accelerometer capable of measuring linear accelerations in a first axis, a second axis, and a third axis and a gyroscope capable of measuring an angular rate of rotation about the first axis, the second axis, and the third axis, wherein the first axis, the second axis, and the third axis are orthogonally oriented in a sensor coordinate system, and a processor. A non-transitory computer readable medium storing computer readable instructions that, when executed by the processor causes the processor to at least: acquire linear acceleration data from the accelerometer, wherein the linear acceleration data is taken at a constant sampling rate; acquire angular rate of rotation data from the gyroscope, where the angular rate of rotation data is taken at a constant sampling rate. The processor may transform the linear acceleration data into transformed linear acceleration data with respect to a golf club coordinate system where the golf club coordinate system comprises a fourth axis may be oriented in a heel-to-toe direction, a fifth axis may be oriented in a front-to-back direction, and a sixth axis may be oriented in a bottom-to-top direction, and transform the angular rate of rotation data into a transformed angular rate of rotation data with respect to the golf club coordinate system. Next, the processor may store, in a circular buffer, the transformed linear acceleration data along the fourth, fifth, and sixth axes and store the transformed angular rate of rotation data about the fourth, fifth, and sixth axes. Then, a start time may be determined for the golf swing, defined as tstart, using the transformed angular rate of rotation data about the fourth axis. Lastly, the processor may solve a loft angle equation at tstart for the golf swing using a linear quadratic estimation method and may solve a lie angle equation at tstart for the golf swing using a linear quadratic estimation method. Once the equations are solved, a calculated loft angle and a calculated lie angle of the golf club head at the start time of the golf swing may be output.

Additionally, another aspect of this disclosure may relate to the non-transitory computer readable medium storing computer readable instructions that, when executed by the processor, further causes the processor to at least: filter the angular rate of rotation data about the fourth axis and store filtered data, wherein the filtered data is defined as Gyf; determine a time associated with a maximum value of Gyf wherein the time associated with the maximum value of Gyf is defined as tmax1; extract a subset of Gyf, corresponding to a range of time between a predetermined time before tmax1, tmax1-*t*1 to tmax1; calculate a derivative of the subset of Gyf; determine a maximum value of the derivative of the subset of Gyf and determine a time, tmax2, corresponding to the maximum value of the derivative of the subset of Gyf; compare the derivative of the subset of Gyf immediately prior to tmax2 to a predetermined angular acceleration value; upon the derivative of the subset of Gyf satisfying the predetermined angular acceleration value, identify a start time of a swing, tstart; and solve a loft angle equation and a lie angle equation at tstart using a linear quadratic estimation method. The angular rate of rotation data about the fourth axis may be filtered using a 4 Hz $2^{nd}$ order Butterworth filter. The golf club may be a putter and where the sensor may be connected near the grip of the golf club. The predetermined angular acceleration value may be 0.02 degrees per second squared or may be within a range of 0.01 degrees per second squared and 0.03 degrees per second squared. Further, the predetermined time may be within a range of 0.8 seconds to 1.2 seconds. Also, the linear quadratic estimation method may be a Kalman filter method to estimate the loft angle equation and the lie angle equation, where the Kalman filter method may be applied from a predetermined filtering time period, tfilter, prior to the time, tstart. The non-transitory computer readable medium storing computer readable instructions for solving the loft angle equation that, when executed by the processor, may cause the processor to: integrate the transformed angular rate of rotation about the fourth axis in equation:

$$\widehat{Loft}_t = \text{Loft}_{t-1} + \omega_x * dt$$

where $\omega_x$ may be the transformed angular rate of rotation about the fourth axis. The processor may then calculate an error estimate using the equation:

$$\widetilde{Loft}_t = \text{Loft}_{accel,t} - \widehat{Loft}_t$$

where $\text{Loft}_{accel,t}$ may be calculated using the transformed linear acceleration data. A Kalman gain term, $k_{loft}$, may be used in equation:

$$\text{Loft}_{t-1} = \widehat{Loft}_t + k_{loft} * \widetilde{Loft}_t$$

where the Kalman gain term may be a function of $\omega_x$*r, where r may be a distance from an origin of the golf club coordinate system to an intersection of a hosel axis to a ground plane. Lastly, the non-transitory computer readable medium storing computer readable instructions for solving the lie angle equation that, when executed by the processor, may cause the processor to: integrate the transformed angular rate of rotation about the fifth axis in equation:

$$\widehat{Lie}_t = \text{Lie}_{t-1} + \omega_y * dt;$$

$\omega_y$ may be the angular rate of rotation about the fifth axis.

$$\widetilde{Lie}_t = \mathrm{Lie}_{accel,t} - \widehat{Lie}_t;$$

The processor may then calculate $\mathrm{Lie}_{accel,t}$ using the transformed linear acceleration data; and $$\mathrm{Lie}_{t-1} = \widehat{Lie}_{t+k_{lie}} * \widetilde{Lie}_t;$$

where a Kalman gain term may be a function of $\omega_x$*r, wherein r may be a distance from an origin of the golf club coordinate system to an intersection of a hosel axis to a ground plane.

Yet another aspect to this disclosure relates to a golf club comprising: a shaft having a first end connected to a golf club head and a second end connected to a grip; a sensor connected to the golf club comprising an inertial measurement unit, a processor, and a power source; an inertial measurement unit, the inertial measurement unit comprising an accelerometer capable of measuring linear accelerations in a first axis, a second axis, and a third axis and a gyroscope capable of measuring an angular rate of rotation about the first axis, the second axis, and the third axis, wherein the first axis, the second axis, and the third axis are orthogonally oriented in a sensor coordinate system. A non-transitory computer readable medium storing computer readable instructions that, when executed by the processor causes the processor to at least: acquire linear acceleration data from the accelerometer, wherein the linear acceleration data is taken at a constant sampling rate; acquire angular rate of rotation data from the gyroscope, wherein the angular rate of rotation data is taken at a constant sampling rate; transform the linear acceleration data into transformed linear acceleration data with respect to a golf club coordinate system wherein the golf club coordinate system comprises a fourth axis is oriented in a heel-to-toe direction, a fifth axis is oriented in a front-to-back direction, and a sixth axis is oriented in a bottom-to-top direction; transform the angular rate of rotation data into a transformed angular rate of rotation data with respect to the golf club coordinate system; store, in a circular buffer, the transformed linear acceleration data along the fourth, fifth, and sixth axes and the transformed angular rate of rotation data about the fourth, fifth, and sixth axes; filter the angular rate of rotation data about the fourth axis and store filtered data wherein the filtered data is defined as Gyf; determine a time associated with a maximum value of Gyf, wherein the time associated with the maximum value of Gyf is defined as tmax1; extract a subset of Gyf corresponding to a range of time between a predetermined time before tmax1, tmax1-*t*1 to tmax1; calculate a derivative of the subset of Gyf; determine a maximum value of the derivative of the subset of Gyf and define a time, tmax2, corresponding to the maximum value of the derivative of the subset of Gyf; compare the derivative of the subset of Gyf prior to tmax2 to a predetermined angular acceleration value; upon the derivative of Gyf satisfying the predetermined angular acceleration value; record a start time of the golf swing, tstart; and output the start time of the golf swing as tstart.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and is not limited in the accompanying figures in which like reference numerals indicate similar elements.

DETAILED DESCRIPTION

Figure 1:
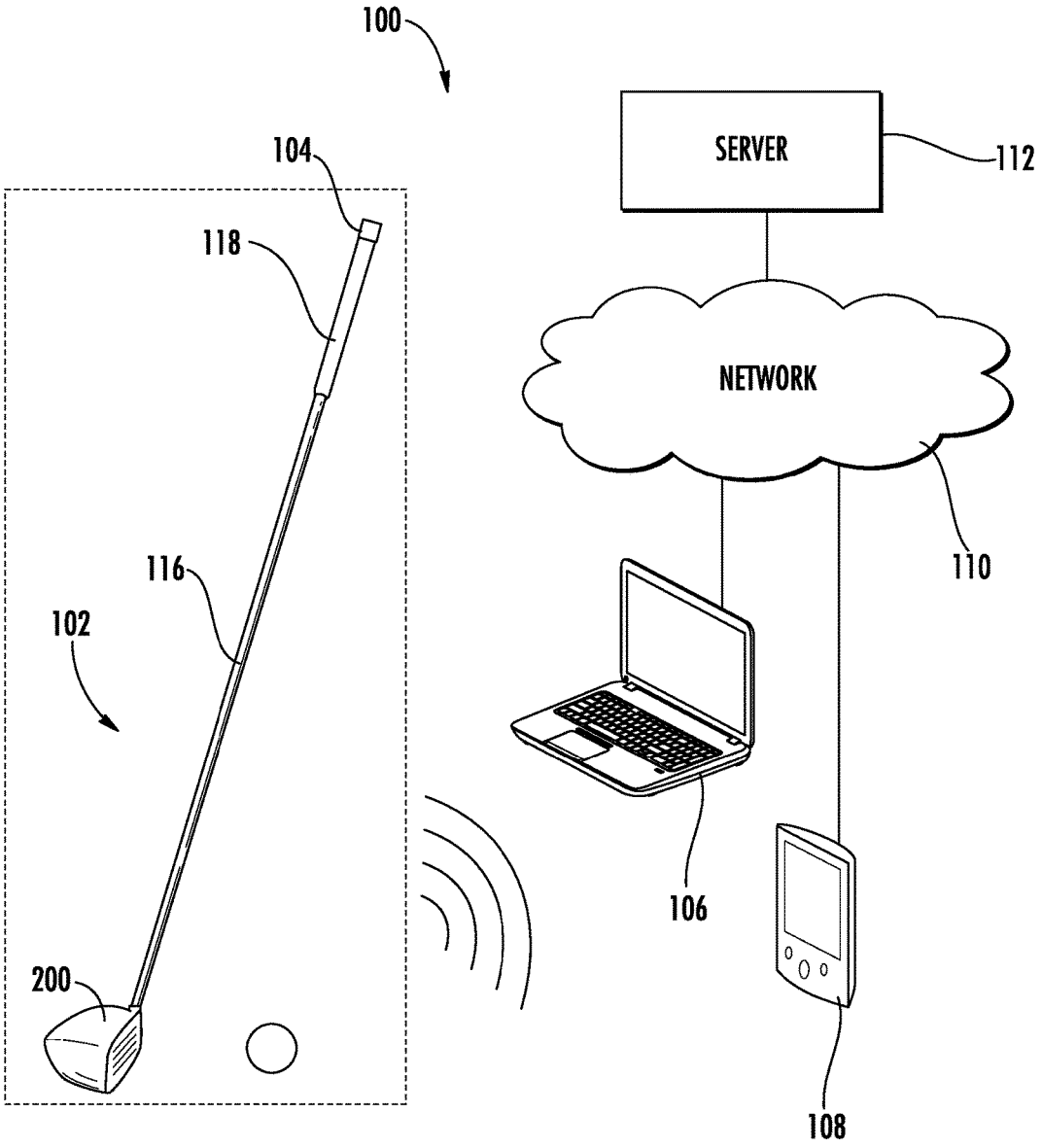
FIG. 1 depicts a schematic view of an example golf analysis system according to one or more aspects described herein.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft member, and it may be attached to the shaft in some manner.

The terms "shaft" or "handle" include the portion of a ball striking device (if any) that the user holds during a swing of a ball striking device.

"Substantially perpendicular" means that two elements are oriented at an angle of 90 degrees or within +/−2 percent of 90 degrees.

In general, aspects of this invention relate to sensors relating to golf swing analysis systems or any type of swing analysis system such as baseball, tennis, racquetball, hockey, any sport that requires a user to have a swinging motion. In general, the swing analysis systems may help a user or coach better by using various numerical analysis, and optionally, computer visualization, to show the golf club head's orientation, velocity and swing path. The user or coach may then identify inefficiencies, or errors, in a user's swing motion. In order to analyze a user's swinging motion, a sensor or plurality of sensors may be positioned on the ball striking device.

The sensor may include an inertial measurement unit, or IMU, capable of measuring linear accelerations and angular rate of rotation along and around three orthogonal (mutually-perpendicular) axes. The IMU may comprise a single accelerometer capable of measuring linear accelerations along three orthogonal axes or three accelerometers oriented to measure linear accelerations along three orthogonal axes, and a single gyroscope sensitive to angular velocities about same the three orthogonal axes as the accelerometer, or three gyroscopes sensitive to angular velocities about same the three orthogonal axes as the accelerometer. As discussed in further detail below, output data from one or more of these three accelerometers and/or three gyroscopes may be processed, in order to calculate and describe a motion of a ball striking device during a swing.

However, placing a sensor comprising an IMU inside of a golf club poses a challenge to power management because of the power consumption of the components of the IMU within the sensor and the limited volume available for a power source or battery. For example, accelerometers may tend to that draw minimal current while being sample rate and accuracy dependent. Conversely, gyroscopes may draw considerably more current compared to the current draw of the accelerometers, up to an order of magnitude greater than an accelerometer, while not being sample rate or accuracy dependent. By utilizing the characteristics of each component type within the IMU, along with intuitive gesture recognition and golf swing properties, a process is needed to minimize power consumption of the IMU located within a golf club.

Another feature using intuitive gesture recognition and golf swing properties can be found in a process to detect the start of the golf swing. To properly analyze the golf swing, the precise time and orientation of the golf club at the exact moment the club impacts the ball must be known. The detection of the time and orientation of the golf club at the moment of impact with a golf ball when using a sensor having an IMU may be made more difficult by the wide variety of other events where the golf club may impact either objects like the ground in an errant swing, tapping a golfer's shoe, or impacting another club while being jostled in a golf bag. A process to decipher a real impact with a golf ball is important to analyze a user's golf swing. In addition, a process that requires no input from the user that a swing a golf ball impact has occurred further enhances the user experience.

Still another aspect of using intuitive gesture recognition and golf swing properties can be found in a process to detect the start of the golf swing. To properly analyze the golf swing, the precise time and orientation of the golf club at the start of the swing must be known. The detection of the time and orientation when using a sensor having an IMU may be made more difficult at the start of the swing because of the wide variety of pre-swing movements and swing styles exhibited by golfers. A process to detect the precise time and orientation of the swing is necessary. In addition, a process that requires no input from the user that a swing is pending further enhances the user experience.

The sensor may include an inertial measurement unit (IMU). An individual IMU may be a single a microelectromechanical systems (MEMS) chip/circuit containing an accelerometer sensitive to linear accelerations along three orthogonal axes, and a gyroscope sensitive to angular rate of rotation or angular velocities about same the three orthogonal axes. Alternatively, the IMU may comprise a plurality of chips/circuits comprising an accelerometer or multiple accelerometers capable of measuring linear accelerations along three orthogonal axes of a sensor coordinate system, and a gyroscope or multiple gyroscopes capable of measuring angular rate of rotation or angular velocities about same the three orthogonal axes.

The various figures in this application illustrate examples of ball striking devices according to this invention. When the same reference number appears in more than one drawing, that reference number is used consistently in this specification and the drawings refer to the same or similar parts throughout.

FIG. 1 illustrates an example system and environment 100 in which various aspects described herein may be used and implemented. In general, sensor data from one or more sensors may be processed to assess one or more characteristics of a user's golf swing. As such, a golf club 102 may be outfitted with a sensor(s) 104 that are removably or integrally connected to the golf club 102. The sensors 104 may be positioned anywhere on the golf club 102 such as the golf club head 200, the golf club shaft 116, or the golf club grip 118. Additionally, these sensors may be connected on the exterior of the golf club 102 or possibly inside the golf club head 200, inside the golf club shaft 116, under the golf club grip 118, or attached to the end of the golf club grip 118. A plurality of sensors 104 may be connected to the golf club 102 at the same time. For example, a sensor 104 may be positioned at the grip 118 end of the golf club 102 and another sensor 104 may be positioned at the golf club head 200, this plurality of sensors 104 may be able to provide the player or coach additional useful information, such as shaft flex characteristics during the golf swing. Additionally, the golf club 102 may be any type of golf club, such as a wood-type, hybrid-type, iron-type, or putter.

Data from these sensor or sensors 104 may be processed on-board the golf club 102 such that raw sensor data may be transformed into data describing of one or more motions of a golf club through a swing. Subsequently, this processed data may be communicated to a remote computing device 106 for review and/or further processing. Alternatively, data from the sensors 104 may be communicated as raw sensor data to be processed by a remote computing device, such as devices 106 and/or 108. Accordingly, the golf club 102 may comprise a transceiver configured to allow for wired and/or wireless communication of data between the one or more sensors 104, and the devices 106 and/or 108. In one example, devices 106 and 108 may comprise consumer electronic equipment, such that device 108 may be a personal computer 106 and device 108 may be a mobile communication device, such as a tablet computer, a personal data assistant (PDA), a smartphone, and/or combinations thereof. Further, personal computer 106 may include one or more laptop computers or desktop computers. Devices 106 and 108 may be connected, via network 110, to a variety of other devices and destinations, including server 112. As such, devices 106 and 108 may include network interfaces that are either wired or wireless or may have both wired and wireless connection interfaces. Wireless connections may be short range or long range, and may include Wi-Fi, BLUETOOTH, infrared, satellite communications, cellular communications and the like. Some devices (e.g., device 108) may include multiple network interfaces and have the capability of transmitting and receiving information over different interfaces depending on a destination/source, time of day, type of information being sent/received and the like. In one example, server 112 may be configured to collect data from various user devices as well as to distribute information such as fitness challenges, golf recommendations, product offers and the like.

As discussed above, the sensor 104 may comprise an IMU that may have a plurality of accelerometers configured to detect linear accelerations along one or more axes, and/or a plurality of gyroscopes, configured to detect the angular rate of rotation or angular velocities about one or more axes. Each accelerometer may be able to measure along three orthogonal axes as well as each gyroscope may be able to measure the angular rate of rotation or angular velocities about each of same the three orthogonal axes of the accelerometer.

Figure 2:
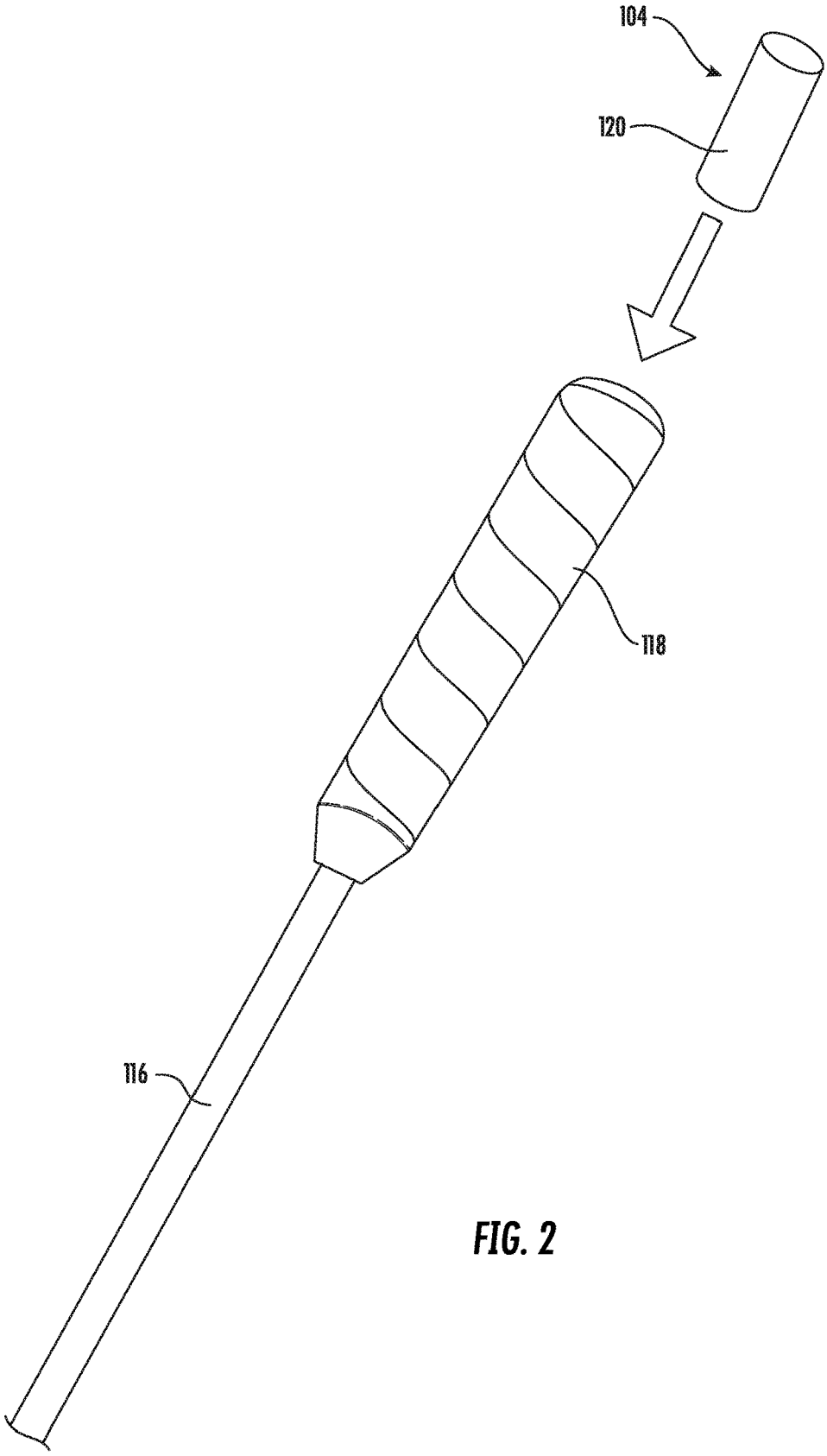
FIG. 2 depicts an example sensor installed into a golf club.

As shown in FIG. 2, the sensor 104 may be positioned inside the golf shaft 116 or golf grip 118. The sensor 104 may have a housing 120 to protect the components of the sensor 104 from the environment. The sensor 104 may have any shape required to be effectively house the components and be mounted onto the ball striking device. For example, the sensor 104 may be a cylinder with a height longer than the diameter as shown in FIG. 2, or conversely, the sensor 104 may have a diameter larger than the height. Alternatively, the sensor 104 may be parallelepiped, or any shape sufficient to house the necessary components.

The housing 120 may enclose and protect the sensor's components from exposure to the external environment. As such, the housing 120 may comprise any shape, size and/or material configured to protect the sensor components. In one specific example, the housing may comprise a material (e.g. a polymer) configured to allow transmission of radio waves, and such that wireless communication between the sensor 104, and an external computing device, such as device 106 and/or device 108, may be facilitated. In other examples, wired communication between the sensor 104 and another computing device, such as devices 106 and 108, may be facilitated.

As discussed above and shown in FIGS. 3, 4, and 5, sensor 104 may comprise an IMU 150. The IMU 150 may comprise an accelerometer capable of measuring linear accelerations in a sensor coordinate system comprising a first axis 152, a second axis 154, and a third axis 156 where each of the first axis 152, the second axis 154 and the third axis 156 are orthogonally oriented. The IMU 150 may further comprise a gyroscope capable of measuring an angular rate of rotation about the first axis 152, the second axis 154 and the third axis 156.

Figure 5:
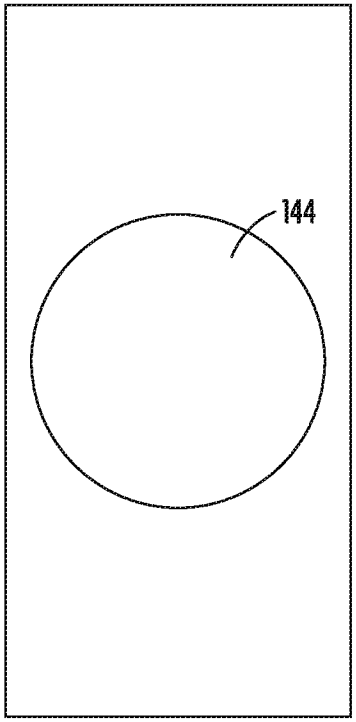
FIG. 5 depicts a rear view of the circuit card assembly FIG. 3.
Figure 4:
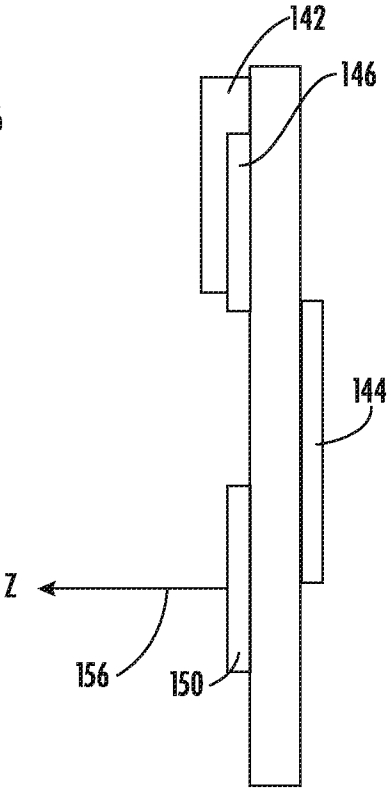
FIG. 4 depicts a side view of the circuit card assembly FIG. 3.
Figure 3:
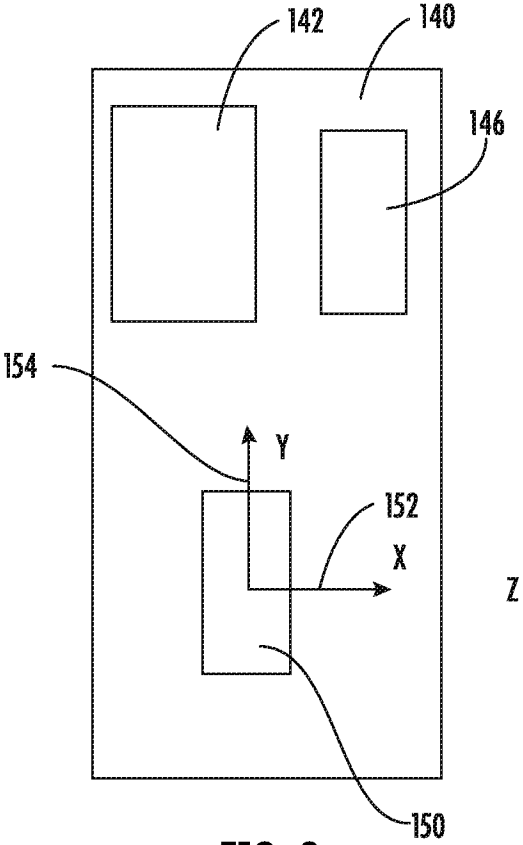
FIG. 3 depicts a front view of a circuit card assembly of a sensor having an inertial measurement unit, according to one or more aspects described herein.

FIGS. 3, 4, and 5 show the components of sensor 104 which may comprise a circuit card assembly (CCA) 140 that includes an IMU 150, a processor 142, a power source 144, and an antenna 146. Additionally, the sensor 104 may further comprise a magnetometer.

The CCA 140 may have any shape and size, but may be preferably sized to have a width and length that may enable the sensor 104 to be small enough to fit within the butt end of a golf shaft 116. The CCA 140 may have electronic components mounted on both sides to minimize the size of the sensor 104. For example, the CCA 140 may have a width of less than 13 mm. The length may be longer than the width and may have a length that at least twice as long as the width. Alternatively, the CCA 140 may have a circular shape and have a diameter of less than 16 mm to fit near the end of the golf grip 118.

The processor 142 may be utilized to process data received from the IMU 150. The processor 142 may be a general-purpose processor, a digital signal processor (DSP), an application-specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, or any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. The one or more implementations described throughout this disclosure may utilize logical blocks, modules, and circuits that may be implemented or performed with a processor.

The processor 142 may be used to implement various aspects and features described herein. As such, the processor 142 may be configured to perform any desired operation on one or more data streams received from the IMU 150. Further, it will be appreciated that the processor 142 may execute multiple calculations, in parallel or serial, at a very high throughput frequency using the received data from the sensor's components, in order to analyze a golf swing. As such, processor 142 may be configured to execute hundreds of thousands, millions, or billions or more calculations per second using the linear acceleration and angular rate data received from the IMU 150. Processor 142 may execute coordinate transformations, curve smoothing, noise filtering, outlier removal, amplification, and summation processes, and the like. In some examples, the sensor 104 may not utilize the processor 142 to process the data received from the IMU 150. Instead, the raw data may be communicated to one or more remote computing devices, such as devices 106 and 108, among others. The processor 142 may include a processing unit and system memory to store and execute software instructions.

The power source 144 may provide power to the sensor 104 including the processor 140, the IMU 150. The power source 144 may comprise, for example, a battery. The battery may be rechargeable and possibly removable.

When the sensor 104 is positioned within the club head 200, the sensor 104 may be positioned so as to not interfere with the aerodynamics of the club 102. Moreover, club head 200 may be configured so that the masses and arrangement of the included components do not change the balance or center of gravity of the club head 200. In one implementation, the mass of the sensor 104 may be less than 7 grams, which may be less than 4% from the mass of an unmodified club head 200.

As discussed above, a sensor 104 may comprise an IMU 150 employed to generate data corresponding to the motion of a golf club 102 throughout a golf swing motion between a first time instant and a second time instant. In one example, the first time instant may correspond to a start of a golf swing motion, or may correspond to a predetermined instant prior to, or after, a detected start of a golf swing motion. Further, the second time instant may correspond to an end of a golf swing motion, or may correspond to a predetermined instant after, or before, a detected end of a golf swing motion, among others. As such, these predetermined times may include any time values, without departing from the scope of these disclosures. In turn, the IMU data may be processed to determine information about the motion of the golf club 102 throughout a swing.

Figure 6:
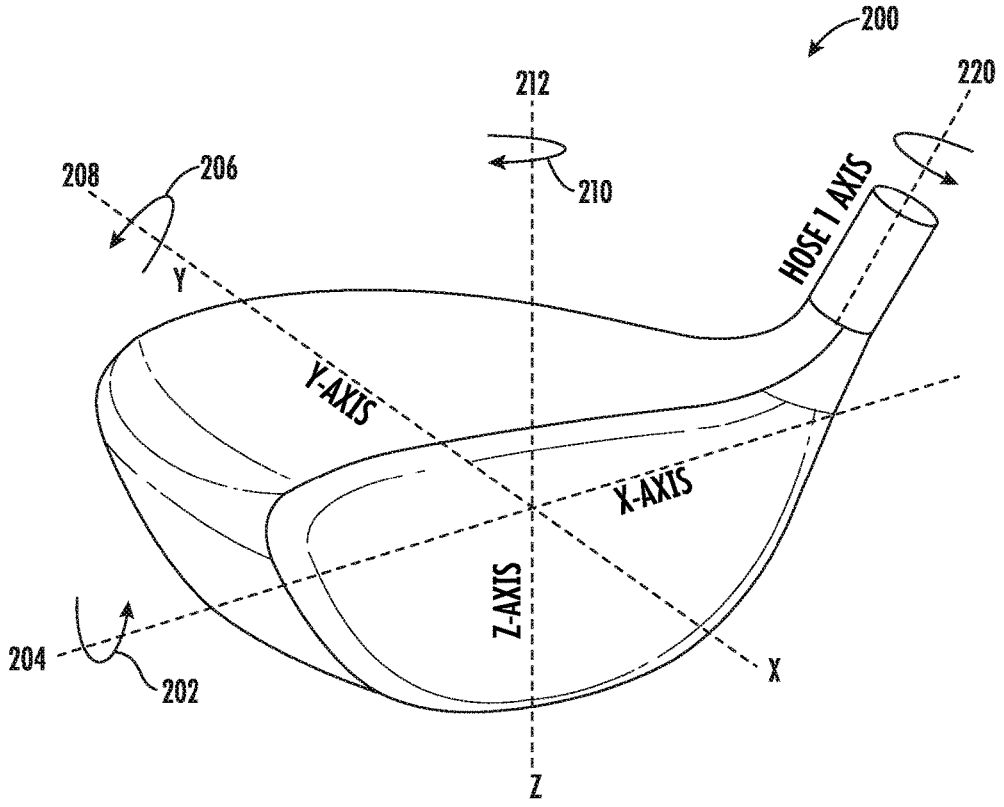
FIG. 6 schematically depicts a golf club head with orthogonal axes along and about which sensors may measure linear accelerations and angular velocities, according to one or more aspects described herein.

The sensor 104 may have a primary coordinate system corresponding to the first axis 152, the second axis 154, and the third axis 156. Depending upon the location and orientation of the sensor 104 on the golf club 102, the linear accelerations and angular rate data of the sensor 104 may be transformed into a golf club coordinate system having an x-axis, y-axis, and z-axis, based around the orientation of golf club head 200 to the ground. FIG. 6 schematically depicts a golf club head 200 with one implementation of a golf club coordinate system about which the sensor 104 data may be characterized. As illustrated in FIG. 6, the golf club coordinate system may be defined with an x-axis 204 parallel to the ground plane in a heel-to-toe direction about which a rotation would correspond to a loft angle of the ball striking face of the golf club head 200, a y-axis 208 in a front-to-back direction that is normal to the x-axis 204 about which a rotation might a lie angle of the golf club head 200 might be measured, and a z-axis 212 in a bottom-to-top direction normal to the x-axis 204 and the y-axis 208 about which a face angle of the golf club head 200 might be measured. Additionally, the rotations about these axes are shown as rotation 202 around the x-axis 204, rotation 206 around the y-axis 208, and rotation 210 around z-axis 212. By transforming the data into this coordinate system, the movements of the club head 200 can be tracked through the golf swing. The origin of the golf club coordinate system may be located at various locations without departing from this disclosure, for example the axes may be located coincident with the axes of the IMU 150 of the sensor 104, on the shaft 116, under the grip 118, at a center of gravity of the golf club head 200, at point 235 at the an intersection of a hosel axis 220 and a ground plane 228 shown in FIG. 7, or at any location on the golf club 102 or sensor 104. While club head 200 depicts a wood-type club, the same type of coordinate transformation may be made if the golf club head 200 is an iron-type, hybrid-type, or putter.

Figure 7:
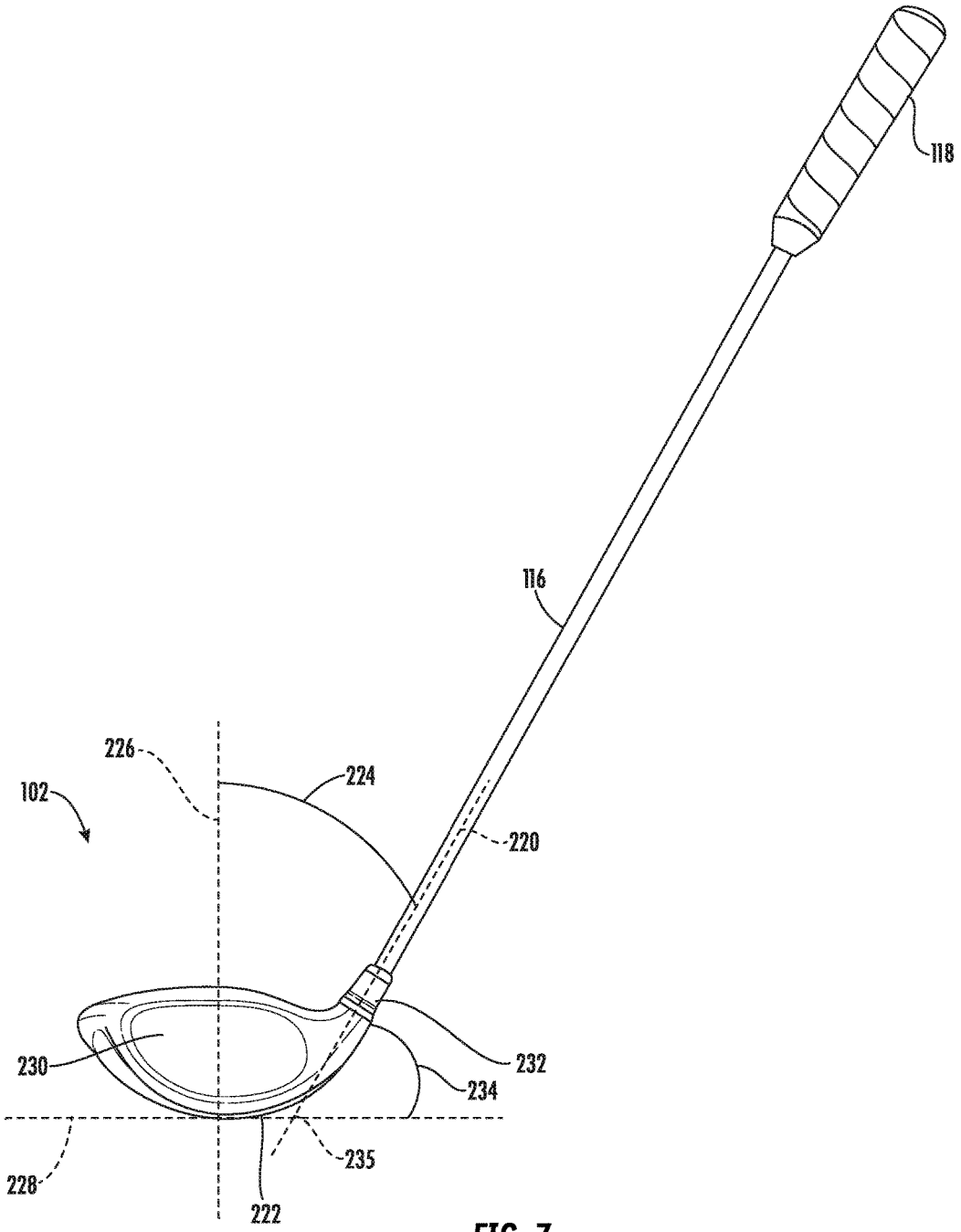
FIG. 7 is an example of a golf club of the golf analysis system of FIG. 1.

FIG. 7 shows the golf club 102 and defines some terminology related to the golf club 102 and golf club head 200. A lie angle 234 may be defined as the angle formed between the hosel axis 220 and a horizontal plane contacting the sole, i.e., the ground plane 228.

Figure 8:
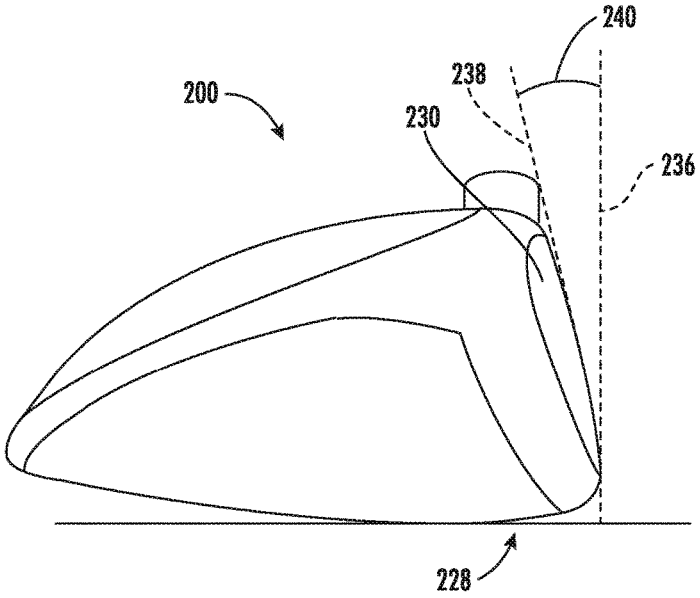
FIG. 8 is an example of a golf club head of the golf club of the golf analysis system of FIG. 1.

FIG. 8 illustrates an example of a loft angle 240 of the golf club head 200. The loft angle 240 can be defined as the angle between a plane 238 that is tangential to the striking surface 230 at the face center location and a plane 236 normal or perpendicular to the ground plane 228.

Data from the sensor 104 may be utilized to mathematically describe the motion of a golf club during a golf swing. This mathematical description may include one or more functions (e.g. functions with respect to time) that may be utilized to calculate the position of a golf club at any given instant in time between defined start and end points of a golf swing. As such, these functions may be used to graphically plot a swing arc, among others (e.g. plot in three dimensions for display on a computer, such as one or more of devices 106 and 108). A graphical representation of a golf swing motion may be generated for display which may be a monitor display of device 106 or device 108. In one example, the calculated golf club location in the global coordinate system may be utilized to plot a graphical representation of the golf swing. Those of ordinary skill in the art will recognize specific processes for generating a graphical display, as well as specific hardware elements (GPUs, and the like), any of which may be utilized with the disclosures described herein. Further, various examples of specific graphics, such as swing path coloring and shading, among others, may be utilized without departing from these disclosures. In one example, the calculated golf swing data may be utilized to compare a user's golf swing to a database of stored swing data. This stored swing data may include previous swings from the user, or model swing data. As such, in one example, this model swing data may be based upon a golf swing of a professional level golfer, among others. Accordingly, the model swing data may be compared to the calculated swing data. The comparison may indicate one or more differences between the model swing data and the calculated swing data such that a user may be provided with feedback about his/her swing.

Accordingly, one or more processes may be executed to calculate a golf club location as where the processor 142 or other device 106 or device 108 may receive the linear acceleration data and angular rate data generated by the IMU's.

Power Management

As previously discussed, accelerometers may tend to that draw minimal current, where their power requirements may be sample rate and accuracy dependent. Conversely, gyroscopes may draw considerably more current compared to the current draw of the accelerometers, up to an order of magnitude greater than an accelerometer and their power requirements may not be sample rate or accuracy dependent. By utilizing the characteristics of each component type within the IMU 150, such as the accelerometer, gyroscope or magnetometer if present, along with intuitive gesture recognition and golf swing properties, a process is needed to minimize power consumption of the sensor 104 located within a golf club 102.

FIG. 7 shows a power management process 300 for the system that may be executed to extend the battery life and implement a power management system. The process may have at least four different states of power consumption by selectively adjusting what components may be powered, the operational frequency, and the accuracy the components. In each state, only the necessary components may be operating with user interactions with the golf club 102 causing the state transitions. By incorporating this process, the sensor 104 connected to the golf club 102 may power on and take data with minimal to no explicit user interaction with the sensor.

The power management process 300, shown in FIG. 7, may use the sensor 104 to detect movements that have golf swing characteristics to minimize power consumption of the sensor. The process 300 may distinguish the current consumption between the different components of the sensor 104 and the different types of movements expressed by a user when handling a golf club. While the swing is being performed, the sensor 104 must be operating with high accuracy at fast sampling frequency. However, when a golf swing is not being performed, only those portions of the sensor 104 necessary to recognize user interaction need to be operating with minimal accuracy and sampling frequency may be needed to detect dramatic changes in user input. The sensors may need to be operating at full speed and resolution prior to the start of the golf swing, so the process may need to estimate when a swing may be pending.

In order to understand the intuitive gesture recognition within the process, an understanding of the different positions a golf club may experience is necessary. For example, the golf club may be: (a) static in a bag in a vertical position with the golf club head 200 at the top or in a horizontal position; (b) transported in a vehicle in a generally horizontal position experiencing slow accelerations and shocks from the movement of the vehicle; (c) held by the user in a manner not consistent with a position used in a golf swing, such as being held on the user's shoulder or a user leaning against club; (d) held by the user a golf swing address position ready to swing (e) in motion in an active swing; (f) at rest leaning against an object where the golf club head 200 may be positioned on the ground or on a shelf. Each of these different positions may generate a different type of signature within the accelerometer and gyroscope within the IMU 150. The power management process 300 may recognize these different signatures and utilize them to transition to the different power states.

Figure 9:
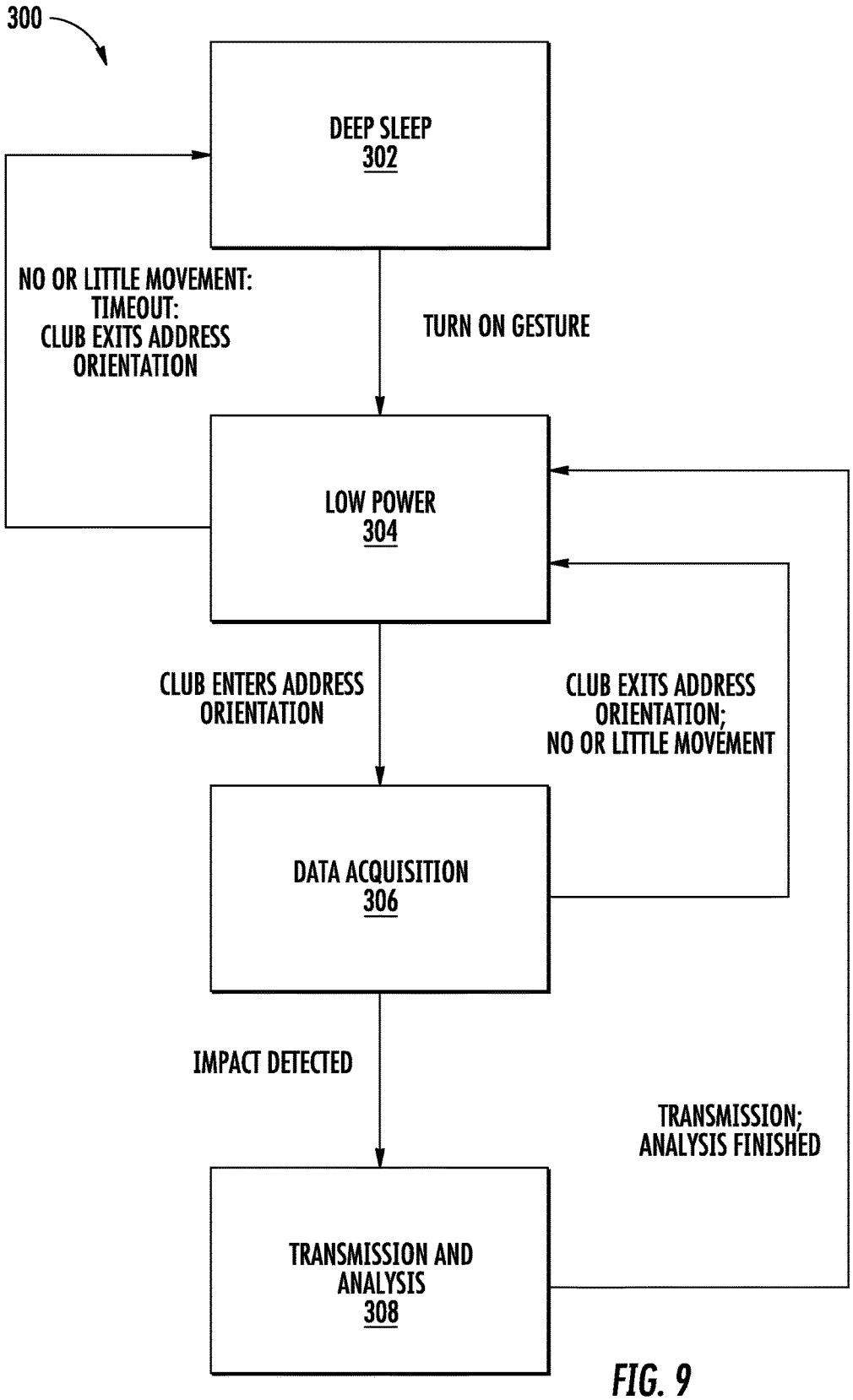
FIG. 9 is an illustrative flowchart diagram of the power management of the sensor, according to one or more aspects described herein.

As shown in FIG. 9, the process 300 may have at least four power states: (a) Deep Sleep 302; (b) Low Power 304; (c) Data Acquisition 306; (d) Transmission and Analysis 308. The details of the different states will be discussed below.

First the Deep Sleep 302 state may have the lowest power consumption. In this state, the gyroscope may be turned off, and the accelerometer may be programmed to generate a signal when a specified acceleration is experienced on one or more of the axes 152, 154, 156 by way of sensing a combined movement and/or orientation. The processor 142 may acquire linear acceleration data along at least one axis from an accelerometer located within the sensor 104 where the accelerometer is operating in a low accuracy, low frequency operating mode with a sampling rate of 10 Hz or less, while restricting power to the gyroscope. The low accuracy, low frequency operating mode may draw less than 100 μA of current. The processor 142 may be also turned on in an extremely low power mode at this time. The processer then may compare the linear acceleration data to a set of predetermined criteria. The set of predetermined criteria may comprise information indicative of non-zero linear acceleration data in at least one axis and the first set of predetermined criteria is satisfied if information indicative of non-zero linear acceleration data in at least one axis. When the linear acceleration data satisfies a first set of predetermined criteria, the processor 142 may be interrupted and may begin execution of the onboard program and transition to the Low Power 304 state. During this time, all unneeded peripheral components may also be turned off.

During the Low Power 304 state, the sensor 104 may determine if a swing is possible in the near future. The accelerometer may operate in a high accuracy but low sampling rate mode with a sampling rate greater than the sampling rate of the Deep Sleep 302 state. For example the sampling rate may be approximately 20 Hz, or within a range of 10 Hz to 50 Hz. The processor 142 may acquire additional linear acceleration data from an accelerometer within the IMU 150 of the sensor 104, while continuing to restrict power to the gyroscope. During this state, the processor 142 may be only performing operations when a sample is ready from the accelerometer and the gyroscope may be in a low power mode. Also during this time, the processor 142 may calculate the orientation of the golf club 102 using the linear acceleration data from the accelerometer. The processor 142 then compares the orientation of the golf club 102 to a set of predetermined criteria. The predetermined set of predetermined criteria may include checking to see if the golf club 102 has entered a rational golf club address position. A rational golf club address position, shown in FIG. 7, may be determined by the golf club 102 being in a position with the sole 222 of the golf club head 200 facing in a downward direction and an angle 224 defined as the angle between a hosel axis 220 and a vertical plane 226 that is perpendicular to a ground plane 228. The angle 224 may be a range within 10 degrees to 45 degrees, or within a range of 0 degrees to 50 degrees.

The predetermined set of criteria in the Low Power state 304 may further comprise analyzing the linear acceleration data to determine if there is no or little movement for a time period of at least 1 second. The amount of movement depends on the balancing of the sensor's 104 sensitivity to noise and responsiveness to a user picking up the golf club 102. For example, an amount of movement required initiate the transition to the Data Acquisition 306 state may be an acceleration of greater than 0.1 g's or greater than 0.05 g's. If this condition is met, then the processor 142 may transition to the Data Acquisition 306 state. While in the Data Acquisition 306 state and the golf club 102 may be in a rational golf club address position, the processor 142 may check to see if any movement has been detected for an extended period of time. For example, if greater than 10 seconds has passed without any movement, the processor 142 may transition the sensor 104 back to the Low Power 304 state and if additional time passes, such as going 15 second without any movement, the processor 142 may transition the sensor 104 back to the Deep Sleep 302 state. Also, if the golf club 102 moves out of the rational golf club address position without sensing any movement for a time longer than 1 second while in the Data Acquisition 306 state, the processor 142 may transition back Low Power 304 state and then transition to the Deep Sleep 302 state. Additionally, while in this Low Power state 304, the processor 142 may occasionally turn on the gyroscope within the sensor 104 to estimate any gyroscopic bias present.

During the Data Acquisition 306 state, both the accelerometer and gyroscope of the IMU 150 may be operating at full power, so it is important to spend a minimal amount of time in this state. The sampling rate of both the accelerometer and gyroscope is greater than in either of the Deep Sleep 302 or Low Power 304 states. For example, the sampling rate may be approximately 200 Hz, or within a range of 175 Hz to 400 Hz, or within a range of 150 Hz to 1 kHz. The processor 142 may be active and storing sampled data in a circular buffer. If the processor 142 senses linear acceleration and angular rate of rotation data, that satisfies a predetermined set of criteria, the processor 142 may transition to the Transmission and Analysis 308 state. This predetermined set of criteria may comprise an Impact Detection algorithm 400 to determine if the golf club impacted with a golf ball being detected. The Impact Detection algorithm 400 will be discussed later in this disclosure.

Additionally, during the Data Acquisition 306 state, the processor 142 may transition the sensor 104 back to the Low Power 304 state, if yet another set of predetermined criteria are satisfied that may include the golf club 102 being at rest static for a period of time, such as 5 seconds or 10 seconds. Additionally, the processor 142 may return back to the Low Power 304 state if it senses that the golf club 102 has exited the rational golf club address position for a time greater than 1 second.

During the Transmission and Analysis 308 state, a set of golf related metrics may be calculated from the acquired data and transmitted to a remote computing device 106. The transmission rate may be approximately 1 MB/s to better optimize the distance the sensor 104 may be able to transmit. Additionally, the transmission rate may be within a range of 0.75 MB/s and 2 MB/s. Alternatively, the acquired data may be transmitted to a remote computing device 106 for processing into a set of golf related metrics. During this state, both the accelerometer and gyroscope of the IMU 150 are in a low power mode and are not returning data. When the processor 142 completes data transmission, the processor may return to the Low Power 304 state.

By using the timed periods of no sensed movement, instances when the golf club 102 may be stored in a rational golf club address position may be identified so the sensor 104 may be put into the Deep Sleep 302 state.

The power management process 300 provides an intuitive user experience that doesn't require any explicit commands from the user. The typical user experience may be as follows: (a) the user stores their golf club 102 in between golf rounds, during this time the sensor 104 may be in the Deep Sleep 302 state with minimal power consumption; (b) the user may pick up the golf club 102 and place it in a vehicle for transport to a driving range or golf course, during this time the sensor 104 may experience a set of linear accelerations that will turn the sensor 104 to the low power mode. When this occurs the sensor 104 will detect that the golf club 102 may not be not in a rational golf address position and return to Deep Sleep 302 state with little power cost; (c) after arriving at the golfing destination, the user may remove the golf club 102 from the vehicle and store the golf club 102 in near vertical orientation with the golf club head 200 on top in a bag or lay the golf club 102 flat on the ground. In these orientations the sensor 104 may remain in the Deep Sleep state 302; (d) next, the user may pick up the golf club 102 and hold it in various orientations. When the golf club 102 is moved into a rational golf club address position with some movement, the processor 142 will transition from the Deep Sleep 302 state to the Low Power 304 state. As the processor 142 senses the movement decreases, the processor 142 will transition to the Data Acquisition 306 state. The processor 142 may keep the sensor 104 in this state until an impact with the ball is detected, or the golf club 102 is no longer in a rational golf club address position for a period of time, or no movement is detected for an extended period of time; (e) when impact with a golf ball is detected, the processor 142 may transmit the results to a remote computing device 106; (f) when the user puts the golf club 102 club on the ground or back in a golf bag, the sensor may return to the Low Power 304 state followed by the Deep Sleep 302 state. Thus, the power management process 300 may help to increase the life of the power source 144 of the sensor 104 and enhance the user experience.

Additionally, the power management algorithm 300 may be applied to other sports where long periods of inaction are followed by a dynamic event, such sports include baseball swings, bowling ball throws, pool cue strikes, and football throws.

Impact Detection

Figure 10:
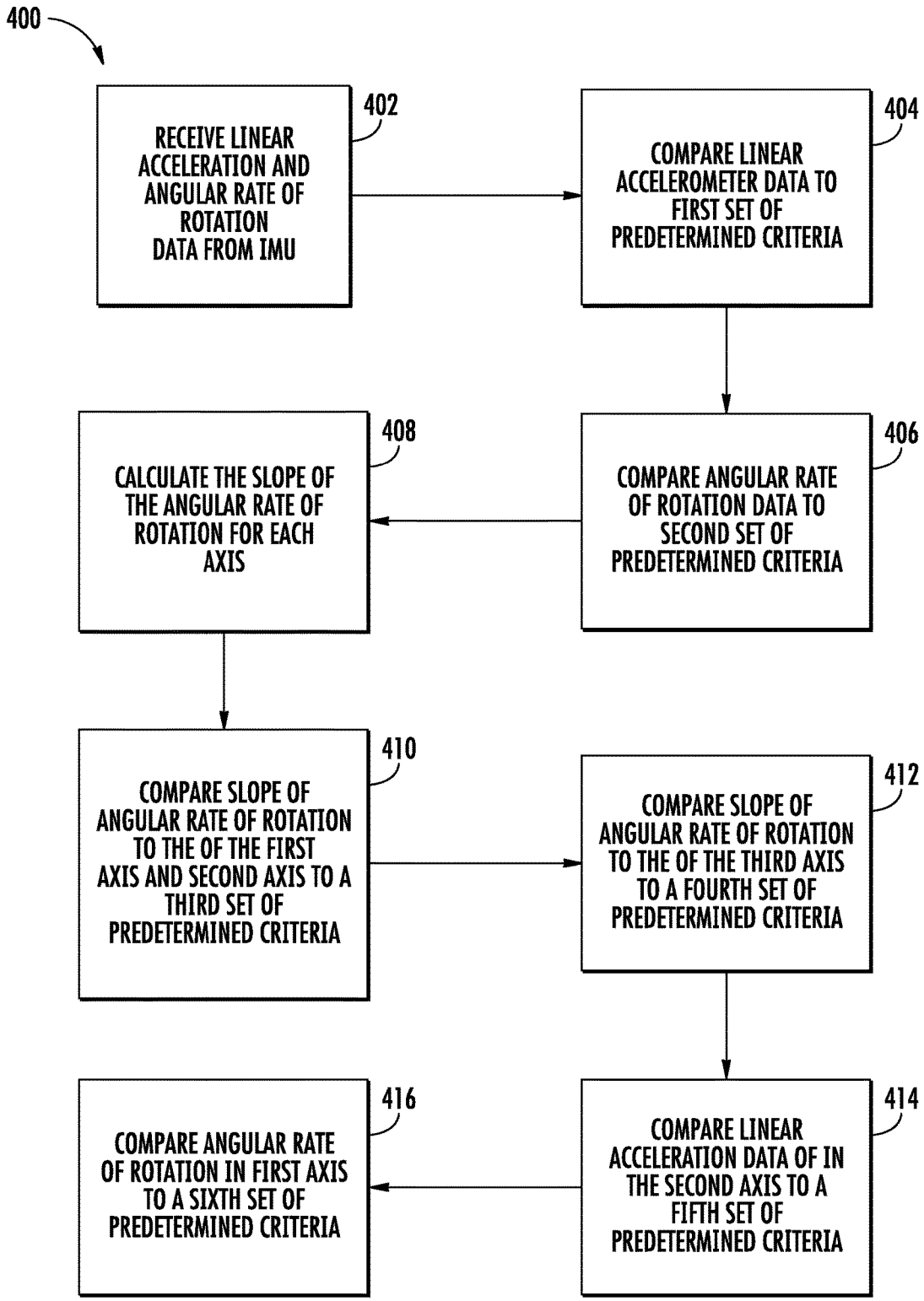
FIG. 10 is an illustrative flowchart diagram for an algorithm to determine if an impact event occurred, according to one or more aspects described herein.

Another aspect to sensor 104 may be the ability to detect when the club impacts the ball. As shown in FIG. 10, an impact detection algorithm 400 to minimize false positives caused by golf club 102 impacts that are not impacts with a golf ball such as setting the club on the ground, tapping the club against a foot, or pushing a ball into position with the club. Sensor 104 may detect and classify impacts in a manner to minimize the power consumption and enhance the user experience. To achieve this detection and classification efficiently, processor 142 uses an impact detection algorithm 400.

The impact detection algorithm 400, much like sensor 104, may work on any type of golf club, such as a wood-type, hybrid-type, iron-type, or putter. Additionally, the impact detection algorithm 400 may be used no matter where the sensor 104 is located on the golf club 102. For example, if the sensor 104 is positioned near the golf club head 200 or near the grip 118.

As discussed above, during the Data Acquisition 306 state, the sensor 104 constantly samples data at a fixed rate. The impact detection algorithm 400 may use the processor 142 to compare either the linear acceleration data or the angular rate of rotation data measured from the sensor 104 or a function of that data to a predetermined set of criteria.

The first two sets of predetermined criteria may detect the golf club 102 movements or positions that indicate that the golf club 102 may not currently exhibit a swing motion. The remaining criteria detect an impact and determine if the club had the proper motion at the time of impact.

First, the linear acceleration data may be acquired from the accelerometer 402. The processor 142 may calculate the orientation of the golf club 102 using the linear acceleration data. The processor 142 may then compare the orientation of the golf club 102 to a first set of predetermined criteria 404. The first set of predetermined set of criteria may include checking to see if the golf club 102 has entered a rational golf club address position. As discussed above, the rational golf club address position, shown in FIG. 8, may be determined by the golf club 102 being in a position with the sole 222 of the golf club head 200 facing in a downward direction and an angle 224 defined as the angle between a hosel axis 220 and a vertical plane 226 that is perpendicular to a ground plane 228. The angle 224 may be a range within 10 degrees to 45 degrees, or within a range of 0 degrees to 50 degrees.

The rational golf club address position may be detectable by measuring the direction of the gravity vector, and may be measured using the linear acceleration data created from the accelerometer within the IMU 150. If the measured data does not satisfy the first set of predetermined criteria, an impact will not be recorded for a specified amount of time. For example, the specified amount of time may be approximately 2 seconds or in a range of 1 to 3 seconds. Additionally, if the first set of criteria is not met, the sensor 104 may require the golf club 102 to be placed back into a rational golf club address position for specific time period, such as 1 second, before an impact may be recorded. This response may be similar if any of the comparative data does not satisfy any of the predetermined criteria within the impact detection algorithm 400.

Next, the processor 142 may compare the angular rotation data to a second predetermined set of criteria 406. The second set of criteria may detect the saturation of the angular rate of rotation data from the gyroscope of the sensor 104.

For example, this second set of criteria may comprise a parameter where the angular rate of rotation about any axis may not exceed a reasonable range experienced by the golf club 102 during a swing. For example, a reasonable angular rate of rotation experienced by the golf club 102 may be within a range of 250 degrees per second, which may be for a putter and 2800 degrees per second, which may be for a driver. Additionally, if the angular rate of rotation is outside of this range, an impact may be determined to not have occurred and may require the sensor 104 to wait a specified amount of time as described above. The parameter for the minimum and the maximum range for angular rate of rotation may be the same for each axis. Alternatively, the parameter for the minimum and the maximum range for angular rate of rotation may be different for each axis. Once the first two criteria are met, the processor 142 may output an indication that the golf club is in a rational golf club address position and an indication that the transformed angular rate of rotation data represent a golf swing.

Once the first two criteria are met, the processor 142 may calculate and compare a slope of the angular rate of rotation to a third set of predetermined criteria 408, 410. The slope may be calculated by taking the derivative of the angular rate of rotation data of each axis. When the golf club 102 strikes the ball, even on a putt with low impact velocity, the angular rate of rotation measured from the gyroscope may have large slopes during the impact event. These slopes may be different based upon the location of the sensor 104 and the golf club characteristics such as shaft length and the type of golf club head. In addition, the slope may be present on only a portion of the sensing axis such as y-axis 208, which corresponds to face angle rotation and x-axis 204, which corresponds to a loft angle rotation. Thus, the third set of predetermined criteria may comprise a slope of the angular rate of rotation corresponding to a face angle rotation being greater than a specified slope and a slope of the angular rate of rotation corresponding to a loft angle rotation being greater than a specified slope. For example, the third set of predetermined criteria for a sensor 104 mounted near the grip on a putter may be met if the slope of the angular rate of rotation about the y-axis 208 is greater than 226 degrees per second squared (226 deg/$s^2$) and the slope of the angular rate of rotation about the axis x-204 is greater than 226 degrees per second squared (226 deg/$s^2$). If the slopes of the angular rate of rotation are outside of this range, the impact may be determined to not be an impact with a golf ball. The sensor 104 may then require the sensor 104 to wait a specified amount of time as described above.

Once the first three criteria are satisfied, the processor 142 may compare a slope of the angular rate of rotation to a fourth set of predetermined criteria 412. Similar to the third set of predetermined criteria, the fourth set of predetermined criteria may use the slope of angular rate of rotation about the z-axis 212, which corresponds to face angle rotation to confirm that the impact was not a ground strike by the heal of the club, such as when the golfer sets the club down on the ground. This fourth set of criteria may comprise a slope of the angular rate of rotation corresponding to a face angle rotation being less than a specified slope. For example, the fourth set of predetermined criteria for a sensor 104 mounted near the grip on a putter may comprise the slope of the angular rate of rotation about the axis z-axis 212 is less than 226 degrees per second squared (226 deg/$s^2$). If the slope of the angular rate of rotation is outside of this range, the impact may be determined to not be an impact with a golf ball. The sensor 104 may then require the sensor 104 to wait a specified amount of time as described above.

Once the first four criteria are satisfied, the processor 142 may compare the linear acceleration data along y-axis 208, which is positioned in a front-to-back direction, to a fifth set of predetermined criteria 414 to verify that the club is not excessively delofted, such as when the golf club strikes the ground with the face of the club. Thus, the fifth set of predetermined criteria may comprise a linear acceleration value along a y-axis 208 less than a predetermined acceleration value. For example, the fifth set of predetermined criteria for a sensor 104 mounted near the grip on a putter may comprise the linear acceleration data along y-axis 208 having a linear acceleration less than 0.24 g's. Alternatively, the fifth set of predetermined criteria may comprise that a linear acceleration along the y-axis 208, corresponding to a front to back direction, is above a specified value to validate that the golf club 102 is travelling in the correct direction. If the linear accelerations do not meet the specified criteria, the impact may be determined to not be an impact with a golf ball. The sensor 104 may then require the sensor 104 to wait a specified amount of time as described above.

Once the first five criteria are satisfied, the processor 142 may compare the angular rate of rotation about the x-axis 204, corresponding to a rotation about the loft axis, is above a minimum value, to a sixth set of predetermined criteria 416. An angular rate of rotation about the x-axis 204 may almost always be present during an impact event. Thus, the sixth set of predetermined criteria may verify that the angular rate of rotation about the x-axis 204 is greater than a specified value. For example, the sixth set of predetermined criteria for a sensor 104 mounted near the grip on a putter may comprise the linear acceleration data along x-axis 204 be greater than −18.6 degrees per second. Again, if the angular rate of rotation does not meet the specified criteria, the impact may be determined to not be an impact with a golf ball. The sensor 104 may then require the sensor 104 to wait a specified amount of time as described above.

For each of the above criteria, the processor 142 may do a simple comparison and subtraction statements of values stored in integer format. Only three values may need to be stored in memory between time samples. Thus memory requirements and computation time may be minimal.

Swing Start Detection and Orientation

Figure 11:
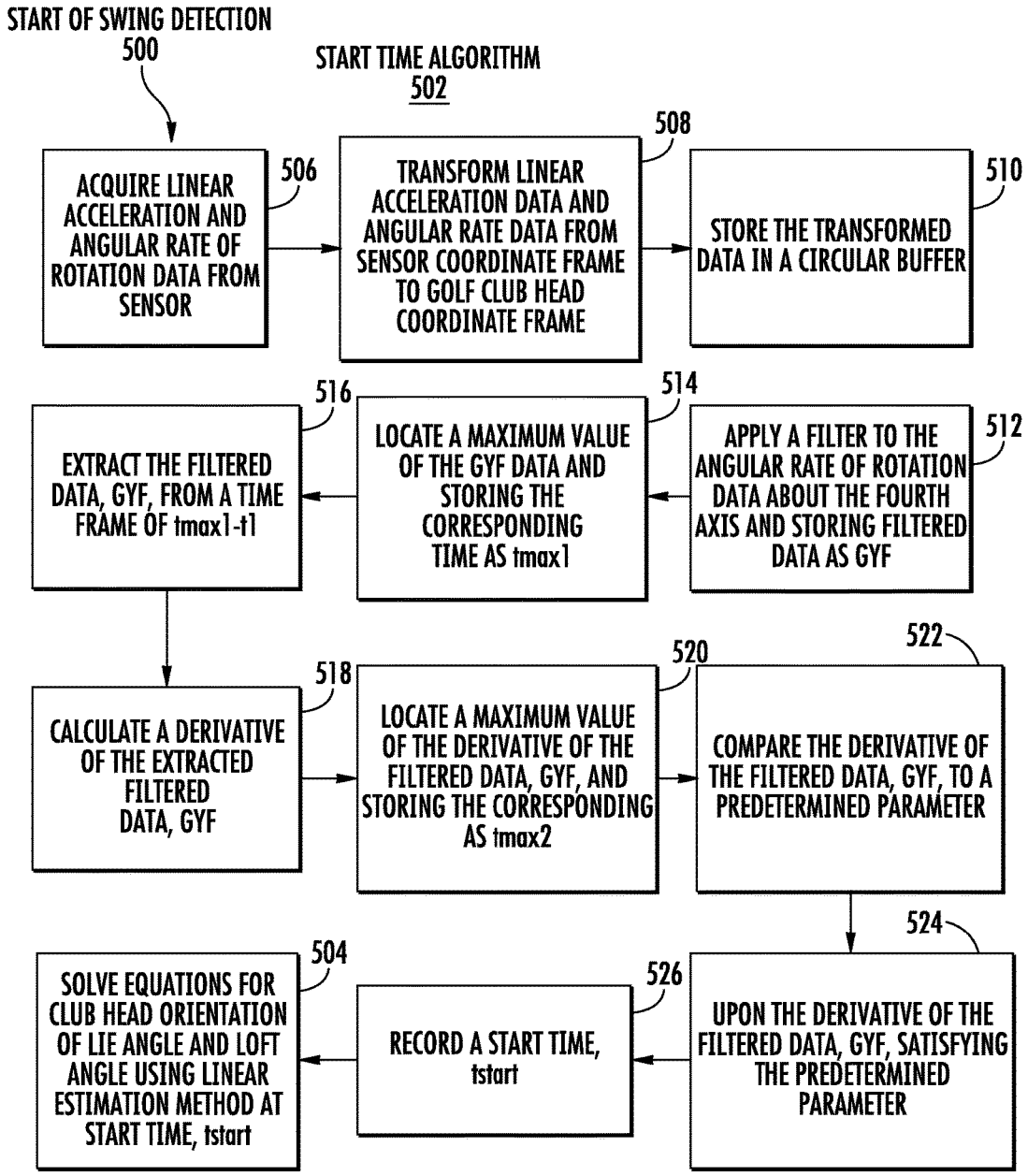
FIG. 11 is an illustrative flowchart diagram of the algorithm to detect the start of the golf swing, according to one or more aspects described herein.
Figure 12:
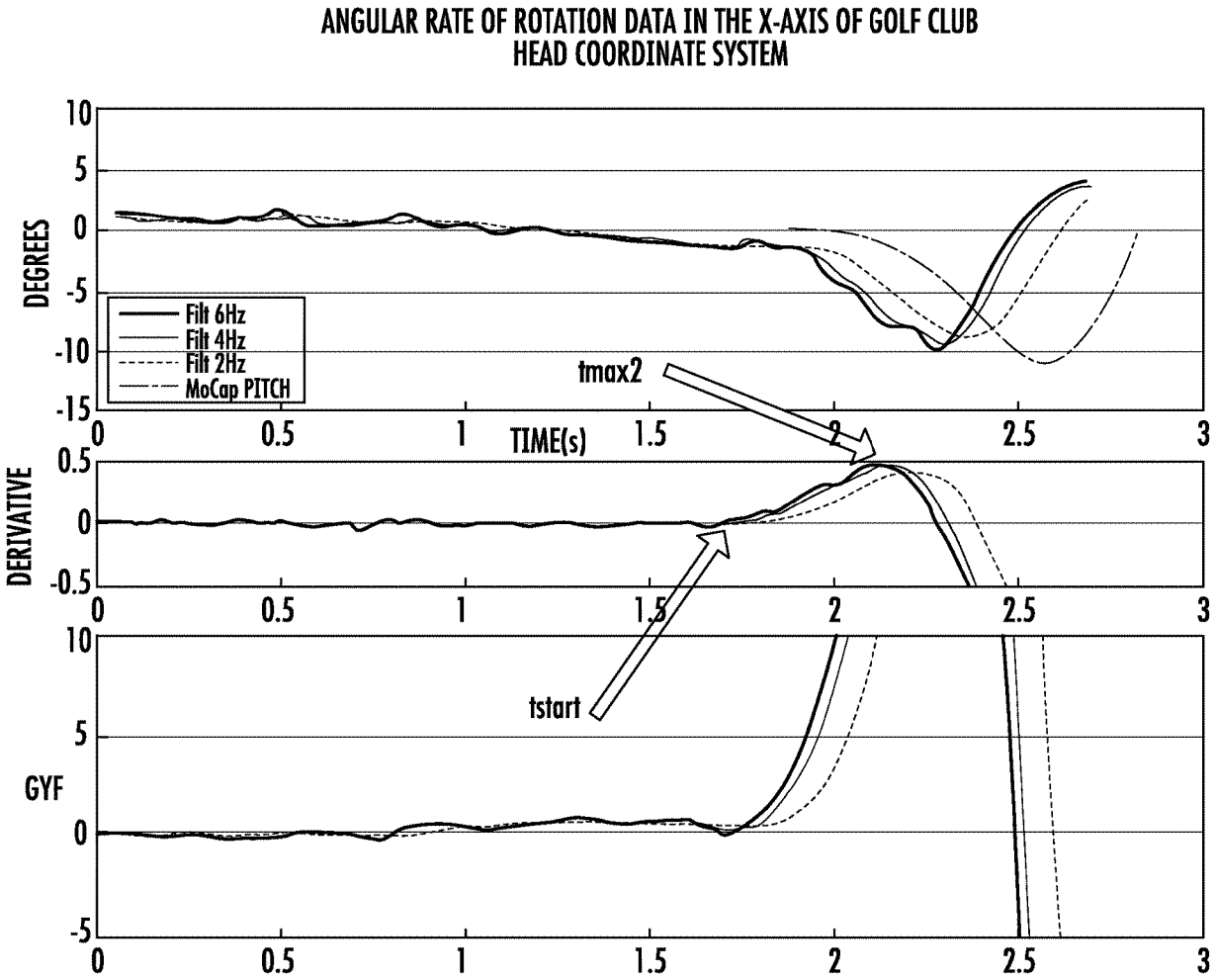
FIG. 12 is a graph showing data used to detect the start of the golf swing using the algorithm of FIG. 11.
Figure 13:
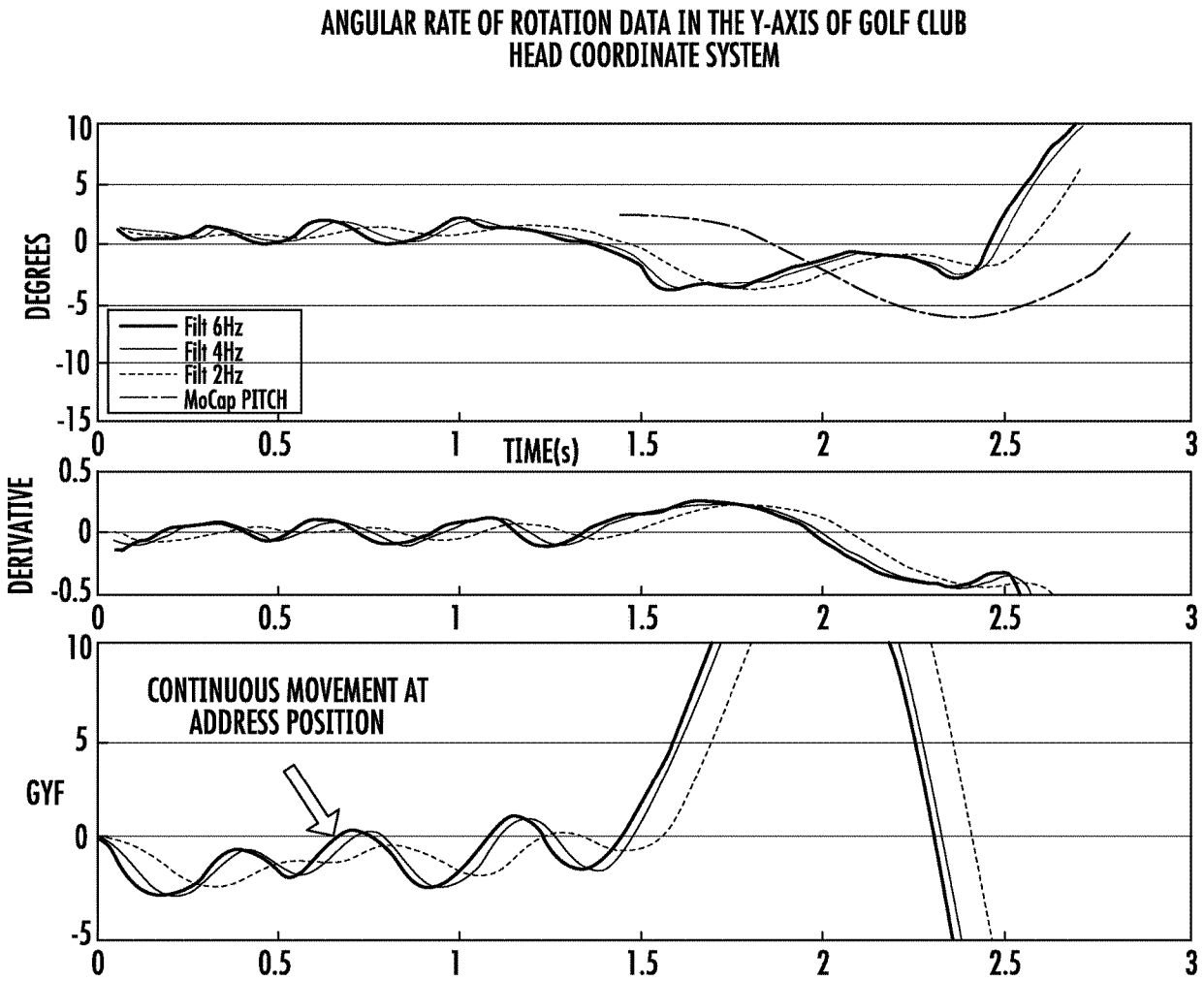
FIG. 13 is a graph showing data measured to show the movement prior to the start of the golf swing.

Upon determining that an impact with a golf ball has occurred, the next step in golf swing analysis may be to determine the time and golf club orientation at the start of the golf swing. To fully analyze a golf swing, the golf club head's orientation, velocity, and path needs to be accurately tracked. A golfer may work to return the golf club at impact to the same position and orientation that it started. As discussed previously, the sensor 104 may be used to provide data to be able to track the golf swing. One component to swing analysis is determining the exact time and golf club head 200 orientation at the start of the golf swing. Because much of the value from golf swing analysis may come by comparing relative changes during the golf swing, an accurate starting point is necessary. A golfer may present various movements and may be in continuous motion while in an address position prior to the golf swing such as waggles, presses, slides, and other movement as shown in the measurements presented in FIG. 13. These movements may impart dynamic accelerations and rotations upon the sensor 104, which may cause instantaneous orientation estimates from the accelerometer within the IMU 150 portion of the sensor 104 to be unavailable. Thus, as shown in FIGS. 11-13, a swing start detection algorithm 500 that may detect both when a swing-like movement begins and estimate the golf club head 200 orientation at that time is necessary.

The swing start algorithm 500 may detect the start of the swing from the data generated from the sensor. The algorithm may model the golf club as a pinned connection at the hosel axis 220 and the ground plane 228 and uses an optimal filter that discriminates translational motion from rotational motion. Using this discrimination, the start time of the swing and the corresponding golf club orientation at the start time may be determined.

As discussed above, the sensor 104 may be mounted anywhere on the golf club 112, such as the golf club head 200, golf club shaft 116, or the golf club grip 118. When the golf club 112 is in the Data Acquisition 306 state, the processor 142 may collect and store the linear acceleration and angular rate of rotation data from the IMU 150 in a circular buffer until an impact event is detected. When an impact event is detected, the data in the circular buffer may be analyzed to extract the time and orientation of the club at the start of the swing. The algorithm to analyze this data may be made of two components, a time estimation component 502 and an orientation estimation component 504 shown in FIGS. 11-13.

The time estimation component 502 may comprise several steps. The initial step 506 may be to acquire the linear acceleration and angular rate of rotation data from the sensor 104. Next, the linear acceleration and angular rate of rotation data may be transformed into the golf club coordinate system as described above 508, having an x-axis 204, y-axis 206, and z-axis 208. The processor may then store the transformed data in a circular buffer 510.

The transformed angular rate of rotation data about the x-axis 204, or loft plane axis may be filtered and stored 512. The filtered data angular rate of rotation data may be defined as Gyf. The filter used for this step may be a low pass filter such as a 4 Hz $2^{nd}$ order Butterworth filter. Prior to filtering the data, the bias of the angular rotation data should be estimated and removed. A time associated with a maximum value of Gyf may then be determined 514, where the time associated with the maximum value of Gyf is defined as tmax1 (note that tmax1 is not shown in FIG. 12). Tmax1 time may be at approximately the midpoint of the back swing portion of the golf swing.

Because the swing start time, tstart, may be within a range from a predetermined time, t1, prior to tmax1 in a range of tmax1-*t*1, which may be written tmax1-*t*1 to tmax1. A subset of the filtered data, Gyf, may be extracted from the time range from tmax141 to tmax1 and used for the remainder of the calculations 516. For example, for a putter swing with the sensor 104 mounted near the grip 118 of the golf club 102, the predetermined time, t1, may be approximately 1 second or within a range of 0.8 seconds to 1.2 seconds. However, this time, t1, may vary depending upon the type of swing, such as for swinging clubs like irons or metal woods.

Using the range of tmax1-*t*1 to tmax1, the derivative of the filtered data, Gyf, may be calculated 518 to locate the maximum angular acceleration about the x-axis 204 (520). The time tmax2, shown in FIG. 12, may be the corresponding time of the maximum angular acceleration shown in FIG. 12. Lastly, the acceleration about the x-axis 204 prior to the time, tmax2, may be compared to a predetermined angular acceleration value for the derivative of Gyf 522. When the derivative of Gyf in the time range immediately prior to the tmax2 time satisfies the predetermined angular acceleration value, the corresponding time of that derivative of Gyf may be considered the start time of the swing, tstart 524 as shown in FIG. 12. The time, tstart, may then recorded and output for use in the second portion of the algorithm 526. The predetermined angular acceleration value may be different depending on the type of golf club used and the location of the sensor on the golf club. For example, for a sensor 104 connected near the grip of a putter-type golf club, this predetermined parameter may be approximately 0.02 degrees per second squared (or degrees/$s^2$), or within a range of 0.01 degrees/$s^2$ and 0.03 degrees/$s^2$.

The second portion of the process 500 algorithm is the detection of the orientation at the swing start 504. Typically, the orientation of an IMU may be determined by measuring the static acceleration like gravity to determine the orientation. However, an IMU must remain static for this method to work properly. For a golf club at address, the golf club 102 may not be static at all, as shown in FIG. 12. The swing start detection algorithm 500 may provide an accurate orientation of the club head 200 at the start of the golf swing.

The swing start detection algorithm 500 models the golf club 102 as a pinned linkage where the golf club head 200 may be simplified as a device attached to the ground at a point 235 located at the intersection of the shaft axis 220 and the ground plane 228 as shown in FIG. 7. From experimental data and observation, the period immediately prior to the start of a swing may have negligible translational motion but may have significant rotational motion. Using this pinned linkage model, a linear quadratic estimation method may be used to estimate the orientation of the club head 200. For example, a Kalman filter may be used to solve the equations for the loft angle 240 and the lie angle 234 of the club head 200. The Kalman filter may run from a predetermined filtering time period, tfilter, prior to the time of the swing start, tstart, to the swing start time, tstart. Thus, the Kalman filter would apply for a time range of tstart-(tstart-tfilter). For example, the predetermined filtering time period, tfilter, may be approximately 1.25 seconds, or may be within a range of 1.0 to 2.0 seconds.

The initial equations may be initialized with the values of static loft angle and static lie angle based upon known club measurements. Then, for each time step the dynamic loft angle and dynamic lie angle may be estimated by integrating the gyroscopic measurements as shown in equation 1 and 2 respectively (506).

$$\widehat{Loft}_t = \text{Loft}_{t-1} + \omega_x * dt \tag{1}$$

$$\widehat{Lie}_t = \text{Lie}_{t-1} + \omega_y * dt \tag{2}$$

Next an error term may be found by using the accelerometer data to estimate the dynamic Loft and dynamic Lie orientation as in equations 3 and 4. The error estimate may be defined as the difference between the Lie and Loft calculated using the gyroscopes and that using the accelerometers.

$$\widetilde{Loft}_t = \text{Loft}_{accel,t} - \widehat{Loft}_t \tag{3}$$

$$\widetilde{Lie}_t = \text{Lie}_{accel,t} - \widehat{Lie}_t \tag{4}$$

The next step may be to weight the gyroscope based estimate and the accelerometer based estimate using a Kalman gain term, $k_{loft}$ and $k_{lie}$, where the k terms may be determined using the equations for the pinned linkage model and the variances of the accelerometer measurements. The estimate of the orientation at time, t, becomes equations 5 and 6.

$$\text{Loft}_{t-1} = \widehat{Loft}_t + k_{loft} * \widetilde{Loft}_t \tag{5}$$

$$\text{Lie}_{t-1} = \widehat{Lie}_t + k_{lie} * \widetilde{Lie}_t \tag{6}$$

Since the acceleration is constrained to rotation, the amount of acceleration may be estimated as ω·r, where r may be the distance from the point 235 at the "pinned" connection to an origin of the golf club head coordinate frame.

Thus, the k terms may be proportional to the ω·r estimate. The magnitude of the k value to ω·r. relationship may be set by the desired tolerance of the orientation estimate. Each unit of rotational acceleration allowed into the accelerometer based orientation measurement may result in an error. For example, a one hundredth of a g of error estimate may result in an angle estimate off by approximately 0.5 degrees. If one degree of error is desired, the k terms relationship with ω·r may be equal to 0.0175 g's making the k terms' values minimal. The k terms values may additionally affect the convergence time in solving the equations. Using larger k terms values may result in the faster convergence time, while if a relationship is chosen with small k terms, the rate of convergence may be slower, which may require longer sampling periods, which may increase the memory needs of the system. Thus, when the ω·r acceleration estimate magnitude is high, the weight of k terms is reduced and vice versa. The benefit of the weighting rather than using a threshold is that even under constant rotation, the state may be estimated, but the estimate may take longer to converge.

For example, a 4 Hz filtered value of the gyroscopes may be used to supply the angular rate to the filter. Upon comparing results of this technique to motion capture data, showed a two sigma error level of IMU calculated loft angle 240 is 0.7 degrees, and for lie angle 234 is 0.6 degrees.

The various embodiments described herein may be implemented by general-purpose or specialized computer hardware. In one example, the computer hardware may comprise one or more processors, otherwise referred to as microprocessors, having one or more processing cores configured to allow for parallel processing/execution of instructions. As such, the various disclosures described herein may be implemented as software coding, wherein those of skill in the art will recognize various coding languages that may be employed with the disclosures described herein. Additionally, the disclosures described herein may be utilized in the implementation of application-specific integrated circuits (ASICs), or in the implementation of various electronic components comprising conventional electronic circuits (otherwise referred to as off-the-shelf components). Furthermore, those of ordinary skill in the art will understand that the various descriptions included in this disclosure may be implemented as data signals communicated using a variety of different technologies and processes. For example, the descriptions of the various disclosures described herein may be understood as comprising one or more streams of data signals, data instructions, or requests, and physically communicated as bits or symbols represented by differing voltage levels, currents, electromagnetic waves, magnetic fields, optical fields, or combinations thereof.

One or more of the disclosures described herein may comprise a computer program product having computer-readable medium/media with instructions stored thereon/therein that, when executed by a processor, are configured to perform one or more methods, techniques, systems, or embodiments described herein. As such, the instructions stored on the computer-readable media may comprise actions to be executed for performing various steps of the methods, techniques, systems, or embodiments described herein. Furthermore, the computer-readable medium/media may comprise a storage medium with instructions configured to be processed by a computing device, and specifically a processor associated with a computing device. As such, the computer-readable medium may include a form of persistent or volatile memory such as a hard disk drive (HDD), a solid state drive (SSD), an optical disk (CD-ROMs, DVDs), tape drives, floppy disk, ROM, RAM, EPROM, EEPROM, DRAM, VRAM, flash memory, RAID devices, remote data storage (cloud storage, and the like), or any other media type or storage device suitable for storing data thereon/therein. Additionally, combinations of different storage media types may be implemented into a hybrid storage device. In one implementation, a first storage medium may be prioritized over a second storage medium, such that different workloads may be implemented by storage media of different priorities.

Further, the computer-readable media may store software code/instructions configured to control one or more of a general-purpose, or a specialized computer. Said software may be utilized to facilitate interface between a human user and a computing device, and wherein said software may include device drivers, operating systems, and applications. As such, the computer-readable media may store software code/instructions configured to perform one or more implementations described herein.

Those of ordinary skill in the art will understand that the various illustrative logical blocks, modules, circuits, techniques, or method steps of those implementations described herein may be implemented as electronic hardware devices, computer software, or combinations thereof. As such, various illustrative modules/components have been described throughout this disclosure in terms of general functionality, wherein one of ordinary skill in the art will understand that the described disclosures may be implemented as hardware, software, or combinations of both.

The one or more implementations described throughout this disclosure may utilize logical blocks, modules, and circuits that may be implemented or performed with a general-purpose processor, a digital signal processor (DSP), an application-specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, or any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The techniques or steps of a method described in connection with the embodiments disclosed herein may be embodied directly in hardware, in software executed by a processor, or in a combination of the two. In some embodiments, any software module, software layer, or thread described herein may comprise an engine comprising firmware or software and hardware configured to perform embodiments described herein. Functions of a software module or software layer described herein may be embodied directly in hardware, or embodied as software executed by a processor, or embodied as a combination of the two. A software module may reside in RAM memory, flash memory, ROM memory, EPROM memory, EEPROM memory, registers, hard disk, a removable disk, a CD-ROM, or any other form of storage medium known in the art. An example storage medium is coupled to the processor such that the processor can read data from, and write data to, the storage medium. In the alternative, the storage medium may be integral to the processor. The processor and the storage medium may reside in an ASIC. The ASIC may reside in a user device. In the alternative, the processor and the storage medium may reside as discrete components in a user device.

Accordingly, it will be understood that the invention is not to be limited to the embodiments disclosed herein, but is to be understood from the following claims, which are to be interpreted as broadly as allowed under the law.

What is claimed is:

1. A golf club comprising:

a shaft and a golf club head, the shaft having a first end connected to the golf club head and a second end connected to a grip;

a sensor connected to the golf club, the sensor comprising:

an inertial measurement unit, the inertial measurement unit comprising an accelerometer capable of measuring linear accelerations along a first axis, along a second axis, and along a third axis and a gyroscope capable of measuring an angular rate of rotation about the first axis, about the second axis, and about the third axis, wherein the first axis, the second axis, and the third axis comprise an orthogonally oriented sensor coordinate system;

a processor; and a non-transitory computer readable medium storing computer readable instructions that, when executed by the processor, causes the processor to at least:

acquire linear acceleration data from the accelerometer of the inertial measurement unit, wherein the linear acceleration data is taken at a constant sampling rate;

acquire angular rate of rotation data from the gyroscope of the inertial measurement unit, wherein the angular rate of rotation data is taken at a constant sampling rate;

transform the linear acceleration data into transformed linear acceleration data with respect to a golf club coordinate system that comprises a fourth axis is oriented in a heel-to-toe direction, a fifth axis is oriented in a front-to-back direction, and a sixth axis is oriented in a bottom-to-top direction;

transform the angular rate of rotation data into transformed angular rate of rotation data with respect to the golf club coordinate system;

calculate an orientation of the golf club from the transformed linear acceleration data;

compare the calculated orientation of the golf club to a first set of predetermined criteria, wherein the first set of predetermined criteria corresponds to the golf club being oriented in a rational golf club address position and wherein the first set of predetermined criteria is satisfied when the calculated orientation of the golf club matches the rational golf club address position;

upon determining that the first set of predetermined criteria is satisfied, compare the transformed angular rate of rotation data to a second set of predetermined criteria, wherein the second set of predetermined criteria comprises a range of transformed angular rate of rotation values and wherein the second set of predetermined criteria is satisfied when the transformed angular rate of rotation data falls within the range of transformed angular rate of rotation values;

upon determining that the second set of predetermined criteria is satisfied, output an indication that the golf club is in the rational golf club address position and an indication that the transformed angular rate of rotation data represent a golf swing, and calculate a slope of the transformed angular rate of rotation data about the fourth axis, the fifth axis, and the sixth axis;

compare the slope of the angular rate of rotation data around the fourth axis and the sixth axis to a third set of predetermined criteria, wherein the third set of predetermined criteria comprises a fourth axis specified slope of angular rate of rotation and a sixth axis specified slope of angular rate of rotation and wherein the third set of predetermined criteria is satisfied when the slope of the transformed angular rate of rotation data around the fourth axis is greater than the fourth axis specified slope of angular rate of rotation and the slope of the transformed angular rate of rotation data around the sixth axis is greater than the sixth axis specified slope of angular rate of rotation;

upon determining that the third set of predetermined criteria is satisfied, compare the slope of the angular rate of rotation data around the fifth axis to a fourth set of predetermined criteria;

wherein the fourth set of predetermined criteria comprises a fifth axis specified slope of angular rate of rotation, and wherein the fourth set of predetermined criteria is satisfied if the slope of the transformed angular rate of rotation data around the fifth axis is less than the fifth axis specified slope of angular rate of rotation;

upon determining that the fourth set of predetermined criteria is satisfied, compare the transformed linear acceleration data along the fifth axis to a fifth set of predetermined criteria, wherein the fifth set of predetermined criteria comprises a specified linear acceleration value along the fifth axis, and wherein the fifth set of predetermined criteria is satisfied if the linear acceleration data is greater than the specified linear acceleration value along the fifth axis;

upon determining that the fifth set of predetermined criteria is satisfied, compare the transformed angular rate of rotation data around the fourth axis to a sixth set of predetermined criteria, wherein the sixth set of predetermined criteria comprises a specified value for angular rate of rotation about the fourth axis and wherein the sixth set of predetermined criteria is satisfied if the angular rate of rotation data around the fourth axis is greater than the specified value for the angular rate of rotation about the fourth axis; and upon determining that the sixth set of predetermined criteria is satisfied, transmit a signal that an impact between a golf ball and the golf club has occurred.

2. The golf club of claim 1, wherein the rational golf club address position comprises the golf club positioned with a sole of the golf club facing downward and wherein an angle from a vertical plane to a hosel axis of the golf club is within a range of 10 degrees to 45 degrees.

3. The golf club of claim 1, wherein the range of transformed angular rate of rotation values is within 250 degrees per second and 2,800 degrees per second.

4. The golf club of claim 1, wherein the golf club is an iron-type club.

5. The golf club of claim 1, wherein the golf club is a wood-type club.

6. The golf club of claim 1, wherein the sensor is positioned near the grip of the golf club.

7. A golf club comprising:

a shaft and a golf club head, the shaft having a first end connected to the golf club head and a second end connected to a grip;

a sensor connected to the golf club comprising a processor and an inertial measurement unit, wherein the inertial measurement unit comprises an accelerometer capable of measuring linear accelerations in a first axis, a second axis, and a third axis and a gyroscope capable of measuring angular rate of rotation about the first axis, the second axis, and the third axis, wherein the first axis, the second axis, and the third axis comprise an orthogonally oriented sensor coordinate system; and a non-transitory computer readable medium storing computer readable instructions that, when executed by the processor, cause the processor to at least:

acquire linear acceleration data from the accelerometer;

acquire angular rate of rotation data from the gyroscope, wherein the linear acceleration data and the angular rate of rotation data are taken at a constant sampling rate;

transform the linear acceleration data into transformed linear acceleration data with respect to a golf club coordinate system where a fourth axis is oriented in a heel-to-toe direction, a fifth axis is oriented in a front-to-back direction, and a sixth axis is oriented in a bottom-to-top direction;

transform the angular rate of rotation data into transformed angular rate of rotation data with respect to the golf club coordinate system;

calculate an orientation of the golf club from the transformed linear acceleration data;

compare the orientation of the golf club to a first set of predetermined criteria; wherein the first set of predetermined criteria corresponds to the golf club being oriented in a rational golf club address position and wherein the first set of predetermined criteria is satisfied if the orientation of the golf club matches the rational golf club address position;

upon determining that the first set of predetermined criteria is satisfied, compare the transformed angular rate of rotation data to a second set of predetermined criteria; wherein the second set of predetermined criteria comprises a range of transformed angular rate of rotation values and wherein the second set of predetermined criteria is satisfied if the transformed angular rate of rotation data falls within the range of transformed angular rate of rotation values;

upon determining that the second set of predetermined criteria is satisfied, calculate a slope of the transformed angular rate of rotation data for the fourth, fifth, and sixth axes;

compare the slope of the transformed angular rate of rotation data around the fourth axis and the sixth axis to a third set of predetermined criteria comprising a fourth axis specified slope of angular rate of rotation and a sixth axis specified slope of angular rate of rotation and wherein the third set of predetermined criteria is satisfied if the slope of the transformed angular rate of rotation data around the fourth axis is greater than the fourth axis specified slope of angular rate of rotation and the slope of the transformed angular rate of rotation data around the sixth axis is greater than the sixth axis specified slope of angular rate of rotation;

upon determining that the third set of predetermined criteria is satisfied, compare the slope of the transformed angular rate of rotation data around the fifth axis to a fourth set of predetermined criteria comprising a fifth axis specified slope of angular rate of rotation, and wherein the fourth set of predetermined criteria is satisfied if the slope of the transformed angular rate of rotation data around the fifth axis is less than the fifth axis specified slope of angular rate of rotation;

upon determining that the fourth set of predetermined criteria is satisfied, compare the transformed linear acceleration data along the fifth axis to a fifth set of predetermined criteria, wherein the fifth set of predetermined criteria comprises a specified linear acceleration value along the fifth axis, and wherein the fifth set of predetermined criteria is satisfied if the linear acceleration data is less than the specified linear acceleration value along the fifth axis;

upon determining that the fifth set of predetermined criteria is satisfied, compare the transformed angular rate of rotation data around the fourth axis to a sixth set of predetermined criteria, wherein the sixth set of predetermined criteria comprises a specified value for angular rate of rotation about the fourth axis and wherein the sixth set of predetermined criteria is satisfied if the angular rate of rotation data around the fourth axis is greater than the specified value for the angular rate of rotation about the fourth axis; and upon determining that the sixth set of predetermined criteria is satisfied; output that an impact between a golf ball and the golf club has occurred.

8. The golf club of claim 7, wherein the rational golf club address position comprises the golf club positioned with a sole of the golf club facing downward and wherein an angle from a vertical plane to a hosel axis of the golf club within a range of 10 degrees to 45 degrees.

9. The golf club of claim 7, wherein the range of transformed angular rate of rotation values is within 250 degrees per second and 2,800 degrees per second.

10. The golf club of claim 7, wherein the golf club is a putter and the sensor is positioned near the grip of the golf club.

11. The golf club of claim 10, wherein the fourth axis specified slope of angular rate of rotation is 226 degrees per second squared and the sixth axis specified slope of angular rate of rotation is 226 degrees per second squared.

12. The golf club comprising of claim 10, wherein the fifth axis specified slope of angular rate of rotation is 226 degrees per second squared.

13. The golf club of claim 10, wherein the specified linear acceleration value along the fifth axis is less than 0.24 g's.

14. The golf club of claim 10, wherein the specified value for the angular rate of rotation about the fourth axis is greater than −18.6 degrees per second.

* * * * *